US006467863B1

(12) United States Patent
Imanaka et al.

(10) Patent No.: US 6,467,863 B1
(45) Date of Patent: Oct. 22, 2002

(54) INK JET RECORDING HEAD, AND INK JET RECORDING DEVICE

(75) Inventors: Yoshiyuki Imanaka; Akihiro Yamanaka, both of Kawasaki; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/587,055

(22) Filed: Jun. 2, 2000

(30) Foreign Application Priority Data

Jun. 4, 1999 (JP) ..... 11-158364

(51) Int. Cl.[7] ..... B41J 29/38

(52) U.S. Cl. ..... 347/9; 347/37; 347/182; 347/192

(58) Field of Search ..... 347/5, 9, 10, 11, 347/12, 15, 17, 19, 37, 43, 182, 184, 189, 192, 194

(56) References Cited

U.S. PATENT DOCUMENTS

| | | | | |
|---|---|---|---|---|
| 4,723,129 A | | 2/1988 | Endo et al. | 346/1.1 |
| 4,724,446 A | * | 2/1988 | Hirahar et al. | 347/184 |
| 4,769,648 A | * | 9/1988 | Kishino et al | 347/5 |
| 4,973,184 A | * | 11/1990 | Sasaki | 347/182 |
| 5,307,093 A | * | 4/1994 | Suzuki et al | 347/17 |
| 5,347,300 A | * | 9/1994 | Futagawa | 347/9 |
| 5,365,257 A | * | 11/1994 | Minowa et al. | 347/17 |
| 5,381,170 A | * | 1/1995 | Mutoh | 347/15 |
| 5,450,111 A | | 9/1995 | Mutoh | 347/78 |
| 6,054,689 A | | 4/2000 | Imanaka et al. | 219/501 |
| 6,076,919 A | * | 6/2000 | Shiroto et al. | 347/60 |
| 6,116,714 A | * | 9/2000 | Imanaka et al. | 347/19 |
| 6,123,404 A | * | 9/2000 | Tanaka et al. | 347/5 |
| 6,126,261 A | * | 10/2000 | Yamanaka | 347/12 |
| 6,149,264 A | * | 11/2000 | Hirabayashi et al | 347/43 |
| 6,231,155 B1 | * | 5/2001 | Udagawa et al. | 347/19 |

FOREIGN PATENT DOCUMENTS

JP 256883 9/1995

OTHER PUBLICATIONS

Patent Abstracts of Japan, vol. 008, No. 016 (m–270) Jan. 24, 1984 & JP 58 177366A (Hitachi).
Patent Abstracts of Japan, vol. 018, No. 554 (m–1691) Oct. 21, 1994 & JP 06198893 A (Hitachi) Jul. 19, 1994.

* cited by examiner

*Primary Examiner*—Eugene Eickholt
(74) *Attorney, Agent, or Firm*—Fitzpatrick, Cella, Harper & Scinto

(57) ABSTRACT

There is disclosed an ink jet recording head comprises a plurality of recording elements for applying an energy to discharge ink, a recording element driver for driving the recording elements, a control circuit for controlling the recording element driver, and a high resolution reference signal generator using a plurality of input signals continuously given from the outside in a predetermined period and generating a reference signal which has a period shorter than the predetermined period, so that recording control is performed by supplying the reference signal to the control circuit. The bluntness of a pulse waveform by the transmission of the signal via a cable, and a radiation noise generated from the cable can be inhibited, and the ink jet recording head can cope with high speed and a multiplicity of nozzles.

26 Claims, 28 Drawing Sheets

(REFERENCE CLOCK SIGNAL)

INK JET RECORDING HEAD, AND INK JET RECORDING DEVICE

BACKGROUND OF THE INVENTION

1. Field of the Invention

The present invention relates to an ink jet recording head for discharging ink to form a desired image on a material to be recorded, and an ink jet recording device.

2. Related Background Art

There has heretofore been known an ink jet recording method comprising: applying heat and other energy to ink; causing a state change with a steep volume change (bubble generation) in the ink; discharging the ink from a discharge port by the action force based on the state change; and attaching the ink to a material to be recorded to form an image, which is a so-called bubble jet recording method. A recording device using the bubble jet recording method is, as disclosed in U.S. Pat. No. 4,723,129, generally provided with a discharge port for discharging ink, an ink channel communicating with the discharge port, and an electrothermal converter as energy generating means disposed in the ink channel to discharge the ink.

According to the recording method, a high-grade image can be recorded at a high speed and with a low noise, and a head for performing this recording method can be provided with highly densely arranged discharge ports for discharging the ink, so that a recorded image with a high resolution by a small device, an easily obtainable color image, and many other superior respects are realized. Therefore, in recent years, the bubble jet recording method has been utilized in a printer, copying machine, facsimile machine and many other office apparatuses, and further utilized in industrial systems such as textile printing equipment.

Additionally, a recording element for generating an energy to discharge the ink can be formed using a semiconductor manufacture process. Therefore, the head utilizing the bubble jet technique is constituted by forming the recording element on an element substrate formed of a silicon substrate, and bonding onto the element a top plate provided with a groove for forming the ink channel and formed of polysulfone, another resin, glass or the like.

Moreover, since the element substrate is formed of the silicon substrate, not only the recording element, but also a driver for driving the recording element, a temperature sensor used for controlling the recording element in accordance with a head temperature, a drive controller, and the like are constituted on the element substrate.

One example of the head substrate is shown, for example, in FIG. 25. Additionally, FIG. 25 shows the constitution as the related art of Japanese Patent Application Laid-Open No. 7-256883.

In FIG. 25, an element substrate 900 is provided with: a plurality of heaters (recording elements) 901, arranged in parallel, for applying a discharging heat energy to the ink; power transistors 902 for driving the respective heaters 901; a shift register 904 to which image data serially inputted from the outside and a serial clock synchronous with the data are inputted, and which latches the image data for each line; a latch circuit 903 for latching the image data for one line outputted from the shift register 903 in synchronization with a latching clock, and transferring the data in parallel to the power transistor 902; a plurality of AND gates 915, disposed for the respective power transistors 902, for applying the output signal of the latch circuit 903 to the power transistor 902 in response to an enabling signal from the outside; and input terminals 905 to 912 for inputting the image data, various signals, and the like from the outside.

Moreover, the element substrate 900 is provided with a temperature sensor for measuring the temperature of the element substrate 900, a resistance sensor for measuring the resistivity of the respective heaters 901, or another sensor 914.

The head constituted by forming the driver, temperature sensor, drive controller, and the like on the element substrate is practically used, and contributes to the enhancement of a recording head reliability and the reduction in size of the device.

In this constitution, the image data inputted as a serial signal is converted to a parallel signal by the shift register 904, and outputted/held by the latch circuit 903 in synchronization with the latching clock. When a drive pulse signal (enabling signal for the AND gate 915) of the heater 901 is inputted via the input terminal in this state, the power transistor 902 turns on in accordance with the image data, an electric current flows in the corresponding heater 901, and the ink of a liquid channel is heated and discharged as a liquid drop from a nozzle tip end.

Here, in the constitution shown in FIG. 25, a main body device in the ink jet recording device monitors the output of the sensor 914 to detect the resistivity of the heater 901, and changes a power voltage and drive pulse width in accordance with the value, so that a substantially constant energy is applied to the heater 901.

In the ink jet recording device described in the Japanese Patent Application Laid-Open No. 7-256883, for a purpose of reducing the load of the main body device of the ink jet recording device, it is proposed to drive the sensor 914, form on the element substrate 900 the drive controller for controlling the drive pulse width of the heater 901 in accordance with the output from the sensor 914, monitor the resistivity of the respective heaters 901 and temperature sensor in the element substrate 900 and detect head property and state and to change the drive pulse width of the heater 901 in accordance with the property and state.

In recent years, for the ink jet recording device, there has been an increasing demand for a higher grade image output in various products and fields. Moreover, a demand for enhancing a recording speed has also increased, and the increase of the number of nozzles for discharging the ink and the shortening of a recording period have been achieved. As a result, the number of the recording elements to be simultaneously driven increases, cost increases because of a necessity of increasing a power capacity, and additionally in respect of fluid the simultaneous discharge of much ink is disadvantageous in performing a stable discharge.

To cope with the problem, it is effective to reduce the number of simultaneously driven recording elements by shortening the width of the drive pulse signal applied to the recording element.

Here, in the conventional example, a head discharge frequency is about 10 KHz (period of 100 $\mu$S), and about 6 $\mu$S per time division in case of a time division number of 16. In this case, one heat signal pulse width can be handled at about 4 to 5 $\mu$S. Here, when the time resolution necessary for generating and controlling a heat signal pulse in the head is of the order of 1/20 to 1/40 of the heat signal pulse, the feedback to the pulse width by the sensor output can be performed, and the clock frequency as a reference for obtaining the resolution is in a range of 5 to 10 MHz (period of 0.2 $\mu$S to 0.1 $\mu$S).

Moreover, when the width of the heat pulse signal is shortened to cope with the increase of a momentary current by the increase of the nozzle number, and the high printing speed, for example, at the drive frequency of 30 KHz and the time division number also of 16, one time division time is only about 2 μS, and the time for one time division is much shorter than the conventional time of about 6 μS. Therefore, in this case, one heat signal pulse width is requested to be set to 2 μS or less (about 0.5 to 1.5 μS). The resolution required for the heat signal in consideration of the pulse width control is in a range of 0.01 μS to 0.07 μS, and the reference clock signal for satisfying this level of the resolution requires a frequency of 15 MHz to 100 MHz (period of 0.07 μS to 0.01 μS).

When the transfer clock frequency of the image data is increased (the period is shortened), the resolution can be enhanced, but the clock signal is usually supplied to the head from the main body device of the recording device as shown in FIG. 25, and the head moving during printing is therefore connected to the main body device with the relatively long cable of a flexible substrate or the like. Since a high current flows in the vicinity of the cable, noises are easily superposed onto the signal transmitted by the cable, and there arises a phenomenon in which pulse waveform rising and falling are lengthened by the inductance component of the cable (waveform gets blunted) (specifically, the waveform of FIG. 26A changes to that of FIG. 26B). This varies the drive time of the recording element. Moreover, when the drive pulse signal period becomes shorter, the variation proportion relatively increases, the influence of the blunted pulse waveform cannot be ignored, the signal cannot accurately be received on a head side, and there is a possibility that malfunction occurs. Moreover, this also shortens the life of the recording element.

Furthermore, when a high-frequency clock is transmitted, the cable acts as an antenna and radiation noise is generated. This radiation noise possibly causes the malfunction in peripherals.

There is a limitation in the increase of the clock frequency to shorten the conventional pulse width in this manner, and it has heretofore been difficult to set the pulse width to 2 μS or less.

As a technique of eliminating the bluntness of the transfer clock waveform and reducing radiation noises, for example, there is proposed a method of radiating signal light to a carriage with a head mounted thereon from a main body device, receiving the signal light on a carriage side to regenerate an electric signal, and thus transmitting a clock to the carriage from the main body device by so-called optical communication.

In this case, however, since the head and carriage move in accordance with the size of the material to be recorded, the signal has to be correctly received in any position. For this purpose the main body device on a transmission side has to radiate intense light in a wide range, and has to turn on/off the light at a high speed. Specifically, since the main body device needs to pass a large current to a light emitting element for use in the optical communication, and the drive element needs to be switched at a high speed, it is difficult to transmit the clock for the head with the increased speed and increased nozzles via light.

SUMMARY OF THE INVENTION

The present invention has been developed to solve the above-described related-art problems, and an object thereof is to provide an ink jet recording head and an ink jet recording device which inhibit the bluntness of a pulse waveform by the transmission of a signal via a cable, and a radiation noise generated from the cable, and which cope with high speed and a multiplicity of nozzles.

To achieve the above-described object, according to one aspect of the present invention there is provided an ink jet recording head comprising: a plurality of recording elements for applying an energy to discharge ink; a recording element driver for driving the plurality of recording elements; a control circuit for controlling the recording element driver; and a high resolution reference signal generator using a plurality of input signals continuously given from the outside in a predetermined period and generating a reference signal which has a period shorter than the predetermined period, so that recording control is performed by supplying the reference signal to the control circuit.

According to another aspect of the present invention there is provided an ink jet recording device comprising: an ink jet recording head comprising a plurality of recording elements for applying an energy to discharge ink, a recording element driver for driving the plurality of recording elements, and a control circuit for controlling the recording element driver; a carriage on which the ink jet recording head is detachably mounted and which is scanned along the surface of a material to be recorded; and a main body device for transmitting a plurality of signals to be used for a recording control to the ink jet recording head. In the ink jet recording device, the ink jet recording head comprises a high resolution reference signal generator for using an input signal continuously given from the outside in a predetermined period and generating a reference signal having a period shorter than the predetermined period, and the recording control is performed by supplying the reference signal to the control circuit.

In the above-described ink jet recording device, since a part of signal period for use in the recording control inside the ink jet recording head can be provided with a high resolution, the period of the signal to be transmitted to the ink jet recording head in which high speed and a multiplicity of nozzles are realized can be set to be substantially the same as the conventional period.

Additionally, "downstream" and "upstream" used in the description of the present invention are used as representations regarding a liquid flow direction toward the discharge port from a liquid supply source via a bubble generation area (or a movable member), or regarding the upward direction of the constitution.

DETAILED DESCRIPTION OF THE PREFERRED EMBODIMENTS

In the present invention, a high resolution reference signal generator is constituted, for example, between a conventional heat signal generator and a print apparatus body, the print apparatus body transfers a clock signal of a conventional level frequency, the high resolution reference signal generator is formed in a head or carriage part, the frequency of the received clock signal is raised in the part, and a high resolution reference clock signal is generated and supplied to the heat signal generator. Since the frequency of the reference signal is raised to obtain a high resolution in the head/carriage part in this manner, a high precision drive signal is generated and supplied even in a high frequency drive head, and the feedback of a sensor, and the like in the head can sufficiently be performed.

The present invention will be described hereinafter in detail with reference to the drawings.

(First Embodiment)

An ink jet recording head will be described as one embodiment to which the present invention can be applied. The head is provided with: a plurality of discharge ports for discharging ink (liquid); a first substrate and second substrate, bonded to each other, for constituting a plurality of liquid channels to communicate with the respective discharge ports; a plurality of recording elements, disposed in the respective liquid channels, for converting an electric energy to a liquid discharge energy in the liquid channel; and a plurality of elements or electric circuits different from one another in function for controlling a recording element drive condition, and the elements or electric circuits are distributed to the first substrate and second substrate in accordance with functions.

Figure 1:
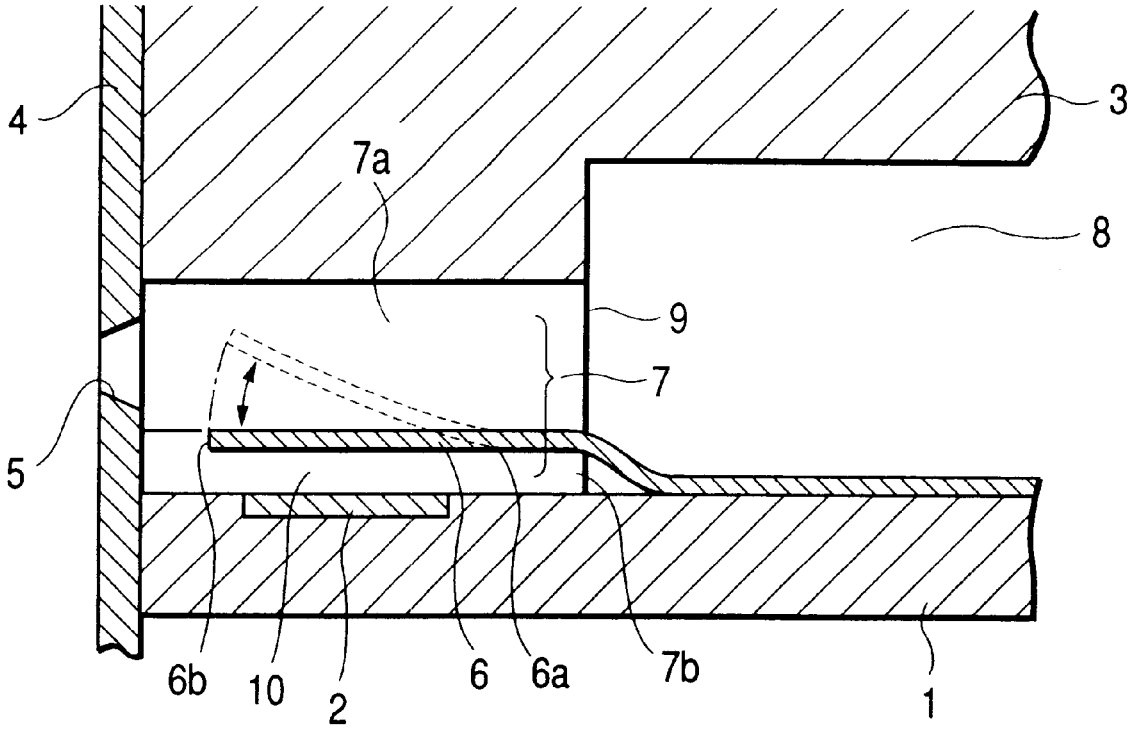
FIG. 1 is a sectional view along a liquid channel direction, showing the structure of an ink jet recording head according to one embodiment of the present invention.

Additionally, an example in which a heating element (heater) is used as the recording element will be described hereinafter, but a piezoelectric element for discharging the ink by a piezo-effect may be used in the recording element. FIG. 1 is a sectional view along the liquid channel direction of the ink jet recording head as one embodiment of the present invention.

As shown in FIG. 1, the ink jet recording head is provided with: an element substrate 1 in which heaters 2 are arranged in parallel as a plurality of (only one is shown in FIG. 1 recording elements for applying a heat energy to generate bubbles in the liquid; a top plate 3 bonded onto the element substrate 1; an orifice plate 4 bonded to the front end surfaces of the element substrate 1 and top plate 3; and a movable member 6 installed in a liquid channel 7 constituted by the element substrate 1 and top plate 3.

In the element substrate 1, a silicon oxide film or a silicon nitride film is formed on a substrate of silicon or the like for a purpose of insulation and heat accumulation, and an electric resistance layer and wiring constituting the heater 2 are patterned on the film. When a voltage is applied to the electric resistance layer via the wiring, and a current is passed to the electric resistance layer, the heater 2 generates heat.

The top plate 3 constitutes a plurality of liquid channels 7 for the respective heaters 2 and a common liquid chamber 8 for supplying liquid to the respective liquid channels 7, and a channel side wall 9 extending between a ceiling part and the respective heaters 2 is integrally disposed. The top plate 3 is constituted of a silicon-based material, and can be formed by etching and forming the pattern of the liquid channel 7 and common liquid chamber 8, or depositing silicon nitride, silicon oxide or another material of the channel side wall 9 on the silicon substrate by a known film forming method such as CVD and then etching and forming the part of the liquid channel 7.

The orifice plate 4 is provided with a plurality of discharge ports 5 which are connected to the respective liquid channels 7 and which communicate with the common liquid chamber 8 via the respective liquid channels 7. The orifice plate 4 is also formed of the silicon-based material and is formed, for example, by scraping the silicon substrate provided with the discharge port 5 to obtain a thickness of about 10 to 150 $\mu$m. Additionally, the orifice plate 4 is not necessarily a constitution required for the present invention, and instead of the orifice plate 4, the top plate provided with the discharge port may be constituted by leaving a wall with a thickness corresponding to the thickness of the orifice plate 4 in the tip end surface of the top plate 3 during the forming of the liquid channel 7 in the top plate 3, and forming the discharge port 5 in this part.

The movable member 6 is a cantilever-shaped thin film, disposed opposite to the heater 2, for dividing the liquid channel 7 into a first liquid channel 7*a* communicating with the discharge port 5 and a second liquid channel 7*b* including the heater 2, and is formed of the silicon-based material such as silicon nitride and silicon oxide.

This movable member 6 is provided with a support 6*a* on the upstream side of a large flow toward the discharge port 5 from the common liquid chamber 8 via the movable member 6 by the liquid discharge operation, and is disposed opposite to the heater 2 at a predetermined distance from the heater 2 so as to cover the heater 2 so that a free end 6*b* is disposed on a downstream side with respect to the support 6*a*. A bubble generation area 10 is formed between the heater 2 and the movable member 6.

When the heater 2 is heated based on the above-described constitution, heat acts on the liquid of the bubble generation area 10 between the movable member 6 and the heater 2, and the bubble is generated on the heater 2 based on a film boiling phenomenon and grows. The pressure with the growth of the bubble preferentially acts on the movable member 6, and the movable member 6 is displaced to open widely on the side of the discharge port 5 centering on the support 6*a* as shown by a broken line in FIG. 1. By the displacement or the displaced state of the movable member 6, the propagation of the pressure based on the bubble generation and the growth of the bubble itself are guided to the side of the discharge port 5, and the liquid is discharged from the discharge port 5.

Specifically, when the movable member 6 is disposed on the bubble generation area 10, and provided with the support 6*a* on the upstream side (the side of the common liquid chamber 8) of the liquid flow in the liquid channel 7 and the free end 6*b* on the downstream side (the side of the discharge port 5), the pressure propagation direction of the bubble is guided to the downstream side, and the pressure of the bubble directly and efficiently contributes to the discharge. Moreover, the bubble growth direction itself is guided to the downstream direction similarly as the pressure propagation direction, and the bubble largely grows on the downstream rather than the upstream. By controlling the bubble growth direction itself by the movable member, and controlling the bubble pressure propagation direction, the fundamental discharge properties such as discharge efficiency, discharge force and discharge speed can be enhanced.

On the other hand, when the bubble enters an anti-foaming process, the bubble rapidly disappears by a synergistic effect with the elastic force of the movable member 6, and the movable member 6 also finally returns to an initial position shown by a solid line in FIG. 1. In this case, to compensate for the reduced volume of the bubble in the bubble generation area 10, or to compensate for the volume of the discharged liquid, the liquid flows from the upstream side, that is, the side of the common liquid chamber 8, and the liquid channel 7 is refilled with the liquid, but the refilling with the liquid is efficiently, rationally, and stably performed by the returning action of the movable member 6.

Moreover, the ink jet recording head of the present embodiment is provided with the circuit and element for driving the heater 2 and controlling the driving thereof. These circuit and element are shared and disposed on the element substrate 1 or the top plate 3 in accordance with the function. Moreover, since the element substrate 1 and top plate 3 are constituted of the silicon material, these circuit and element can easily and finely be formed using a semiconductor wafer process technique.

The distribution constitution of the circuit and element to the element substrate 1 and top plate 3 will next be described.

Figure 2A:
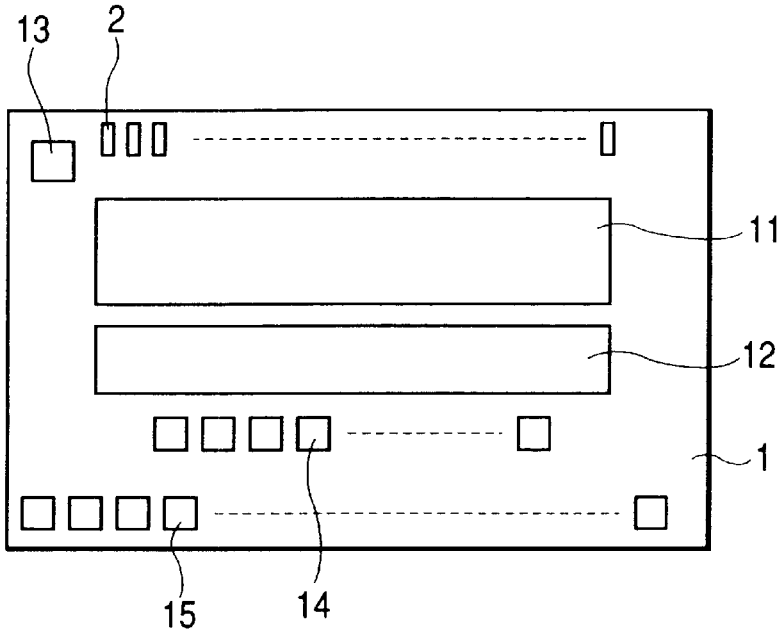
FIGS. 2A and 2B are sectional views of an element substrate for use in the ink jet recording head shown in FIG. 1.
Figure 2B:
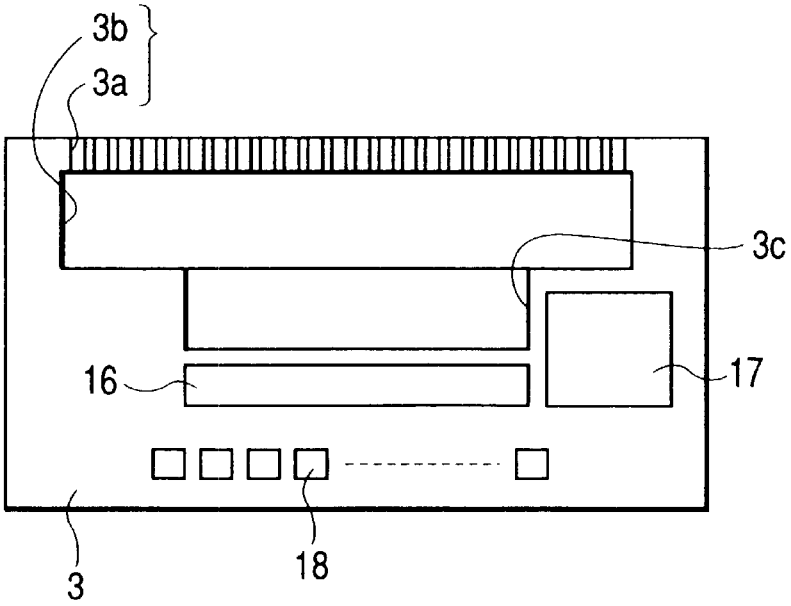

FIGS. 2A and 2B are explanatory views showing the circuit constitution of the ink jet recording head shown in FIG. 1, FIG. 2A is a plan view of the element substrate, and FIG. 2B is a plan view of the top plate. Additionally, FIGS. 2A and 2B show opposite faces.

As shown in FIG. 2A, the element substrate 1 is provided with the plurality of heaters 2 arranged in parallel, a driver 11 for driving these heaters 2 in accordance with image data, an image data transfer portion 12 for outputting the inputted image data to the driver 11, and a sensor 13 for measuring a parameter necessary for controlling the drive condition of the heaters 2.

The image data transfer portion 12 is constituted of a shift register for outputting the serially inputted image data to the respective drivers 11 in parallel, and a latch circuit for temporarily storing the data outputted from the shift register. Additionally, the image data transfer portion 12 may individually output the image data to the respective heaters 2, or may divide the arrangement of the heaters 2 into a plurality of blocks and output the image data by a block unit. Particularly, by providing one head with a plurality of shift registers and performing the data transfer from the recording device main body by distributing and inputting the data to the plurality of shift registers, it is possible to easily cope with the accelerated printing speed.

A temperature sensor for measuring the temperature in the vicinity of the heater 2, a resistance sensor for monitoring the resistivity of the heater 2, or the like is used as the sensor 13.

When the discharge amount of jetted liquid drops is considered, the discharge amount is related mainly with a liquid foam volume. The liquid foam volume changes with the temperature of the heater 2 and its vicinity.

Therefore, by measuring the temperature of the heater 2 and vicinity by the temperature sensor, applying a small energy pulse (preheat pulse) to such an extent that no liquid is discharged before applying a heat pulse to discharge the liquid in accordance with the result, changing the pulse width of the preheat pulse and the output timing to adjust the temperature of the heater 2 and vicinity, and discharging constant liquid drops, the image grade is maintained.

Moreover, when the energy necessary for foaming the liquid in the heater 2 is considered, with the constant radiation condition, the energy is represented by the product of the energy introduced per the necessary unit area of the heater 2 and the area of the heater 2. Therefore, the voltage applied to both ends of the heater 2, and the current and pulse width flowing in the heater 2 may be set to the values at which the necessary energy is obtained. Here, the voltage applied to the heater 2 can be kept substantially constant by supplying more voltage to the power source of the ink jet recording device main body. On the other hand, for the current flowing in the heater 2, the resistivity of the heater 2 varies with a lot, or the element substrate 1 because of the dispersion of the film thickness of the heater 2 in the manufacture process of the element substrate 1. Therefore, when the applied pulse width is constant, and the resistivity of the heater 2 is larger than the set value, the flowing current value is reduced, the energy amount introduced to the heater 2 becomes insufficient, and the liquid cannot adequately be foamed. Conversely, when the resistivity of the heater 2 is reduced, the current value becomes larger than the set value even with the same applied voltage. In this case, an excess energy is generated by the heater 2, and the damage and short life of the heater 2 are possibly caused. Therefore, there is another method comprising: constantly monitoring the resistivity of the heater 2 by the resistance sensor; changing the power voltage and heat pulse width in accordance with the resistivity; and applying a substantially constant energy to the heater 2. Specifically, the discharge amount control element for controlling the ink discharge amount is the heater 2 itself in the constitution.

On the other hand, as shown in FIG. 2B, the top plate 3 is provided with: grooves 3*a*, 3*b* for constituting the liquid channel and common liquid chamber as described above; a sensor driver 17 for driving the sensor 13 disposed on the element substrate 1; and a heater controller 16 for controlling the drive condition of the heater 2 based on the output result from the sensor driven by the sensor driver 17. Additionally, in the top plate 3, a supply port 3*c* is opened to communicate with the common liquid chamber in order to supply the liquid to the common liquid chamber from the outside.

Furthermore, connecting contact pads 14, 18 for electrically connecting the circuit, and the like formed on the element substrate 1 to the circuit, and the like formed on the top plate 3 are disposed on opposite sites of the bonded faces of the element substrate 1 and top plate 3. Moreover, the element substrate 1 is provided with an external contact pad 15 which constitutes the input terminal of the electric signal from the outside. The size of the element substrate 1 is larger than that of the top plate 3, and the external contact pad 15 is disposed in a position which is exposed from the top plate 3 when the element substrate 1 is bonded to the top plate 3.

Here, one example of a procedure of forming the circuits, and the like on the element substrate 1 and top plate 3 will be described.

For the element substrate 1, first the circuits constituting the driver 11, image data transfer portion 12 and sensor 13 are formed on the silicon substrate using a semiconductor wafer process technique. Subsequently, the heaters 2 are formed as described above, and finally the connecting contact pads 14 and external contact pads 15 are formed.

For the top plate 3, first the circuits constituting the heater controller 16 and sensor driver 17 are formed on the silicon substrate using the semiconductor wafer process technique. Subsequently, the grooves 3*a*, 3*b* and supply port 3*c* constituting the liquid channel and common liquid chamber are formed by the film forming technique and etching as described above, and finally the connecting contact pads 18 are formed.

When the element substrate 1 and top plate 3 constituted as described above are positioned and bonded, the heaters 2 are disposed for the respective liquid channels, and the circuits, and the like formed on the element substrate 1 and top plate 3 are electrically connected via the respective connecting pads 14, 18. This electric connection is performed, for example, by laying metal bumps, and the like on the connecting pads 14, 18, but other methods may be performed. By performing the electric connection of the element substrate 1 to the top plate 3 by the connecting contact pads 14, 18, the above-described circuits can electrically be connected to one another simultaneously with the bonding of the element substrate 1 to the top plate 3. After bonding the element substrate 1 to the top plate 3, the orifice plate 4 is bonded to the tip end of the liquid channel 7, so that the ink jet recording head is completed.

Additionally, the ink jet recording head of the present embodiment includes the movable member 6 as shown in FIG. 1, and the movable member 6 is also formed on the element substrate 1 using a photolithography process after forming the circuits, and the like on the element substrate as described above.

Figure 3:
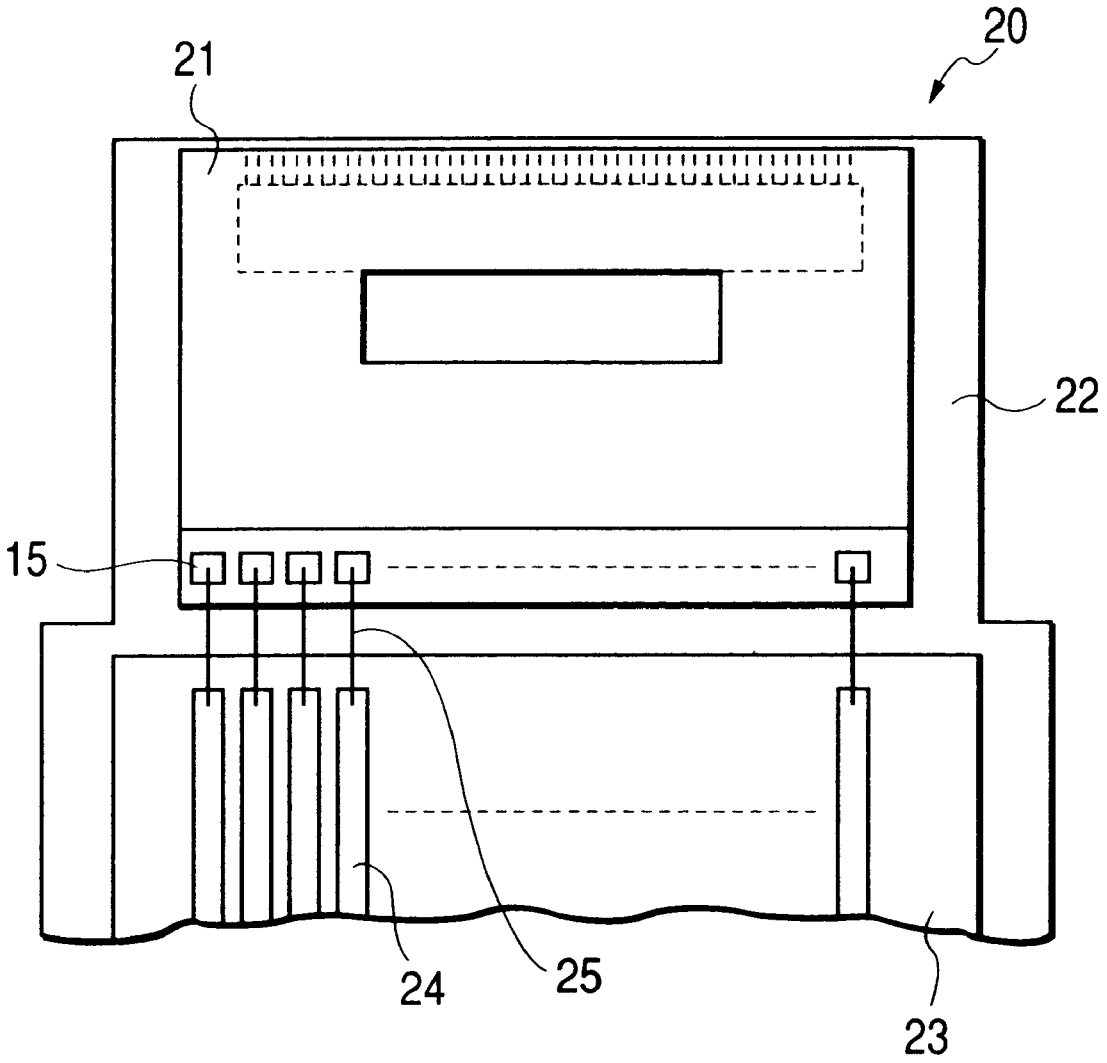
FIG. 3 is a schematic sectional view showing the element substrate which is cut to longitudinally cross the main elements of the element substrate shown in FIGS. 2A and 2B.

When the ink jet recording head obtained in this manner is mounted on a head cartridge or a recording device, as shown in FIG. 3, the head is fixed onto a base substrate 22 with a printed wiring board 23 mounted thereon, and a liquid discharge head unit 20 is formed. In FIG. 3, the printed wiring board 23 is provided with a plurality of wiring patterns 24 electrically connected to the head controller of the recording device, and these wiring patterns 24 are electrically connected to the external contact pads 15 via a bonding wire 25. Since the external contact pads 15 are disposed only on the element substrate 1, a liquid discharge head 21 can electrically be connected to the outside similarly as the conventional ink jet recording head. Here, the example in which the external contact pads 15 are disposed on the element substrate 1 has been described, but the pads may be disposed only on the top plate 3 instead of the element substrate 1.

As described above, when various circuits, and the like for the drive and control of the heater 2 are distributed to the element substrate 1 and top plate 3 by considering the electric bonding of both, these circuits, and the like are not concentrated on one substrate, and the ink jet recording head can be reduced in size. Moreover, by electrically connecting the circuits, and the like disposed on the element substrate 1 to the circuits, and the like disposed on the top plate 3 by the connecting contact pads 14, 18, the number of parts electrically connected to the outside of the head is reduced, and the enhancement of reliability, the reduction of the number of components, and further size reduction of the head can be realized.

Moreover, by dispersing the above-described circuits, and the like to the element substrate 1 and top plate 3, the yield of the element substrate 1 can be enhanced, and as a result, the manufacture cost of the ink jet recording head can be lowered. Furthermore, since the element substrate 1 and top plate 3 are constituted based on the same material of silicon, the thermal expansion coefficient of the element substrate 1 equals that of the top plate 3. As a result, even when the element substrate 1 and top plate 3 are thermally expanded by the driving of the heater 2, no deviation occurs in both, and the position precision of the heater 2 and liquid channel 7 is satisfactorily maintained.

In the present embodiment, the above-described circuits, and the like are distributed in accordance with the functions, and a basic idea for the distribution will be described hereinafter.

The circuits to be connected to the respective heaters 2 individually or by a block unit via electric wiring are formed on the element substrate 1. In the example shown in FIGS. 2A and 2B, this applies to the driver 11 and image data transfer portion 12. Since the drive signals are supplied to the respective heaters 2 in parallel, the wiring needs to be drawn around for the signals. Therefore, when the circuits are formed on the top plate 3, the number of connections of the element substrate 1 to the top plate 3 increases and a possibility of occurrence of connection defect increases, but the connection defect of the heaters 2 and the above-described circuits is prevented by forming the circuits on the element substrate 1.

Analog parts such as the control circuit are susceptible to a heat influence, and are therefore disposed on the substrate with no heaters 2 disposed thereon, that is, the top plate 3. In the example shown in FIGS. 2A and 2B, the heater controller 16 corresponds to this.

The sensor 13 may be disposed on the element substrate 1 or the top plate 3 as occasion demands. For example, for the resistance sensor, since the resistance sensor not disposed on the element substrate 1 has no meaning or the measurement precision is deteriorated, the sensor is disposed on the element substrate 1. Moreover, it is preferable to dispose the temperature sensor on the element substrate 1 in order to detect the temperature rise by the abnormality of the heater driving circuit, but when the ink state is to be judged by the temperature rise via the ink as described later, the temperature sensor is preferably disposed on the top plate 3 or both the element substrate 1 and top plate 3.

Additionally, circuits not connected to the respective heaters 2 individually or by the block unit via the electric wiring, a circuit which does not necessarily has to be disposed on the element substrate 1, a sensor which exerts no influence on the measurement precision even when disposed on the top plate 3, and the like are formed on the element substrate 1 or the top plate 3 as occasion demands so that they fail to be concentrated to either one of the element substrate 1 and top plate 3. In the example shown in FIGS. 2A and 2B, the sensor driver 17 corresponds to this.

By disposing the respective circuits, sensors, and the like on the element substrate 1 and top plate 3 based on the above-described idea, the electric connection number of the element substrate 1 and top plate 3 is minimized, and additionally the respective circuits, sensors, and the like can be distributed with good balance.

The embodiment has been described above with respect to the basic constitution of the present invention, and concrete examples of the above-described circuits, and the like will be described hereinafter.

Example of Control of Energy Applied to Heater

Figure 4A:
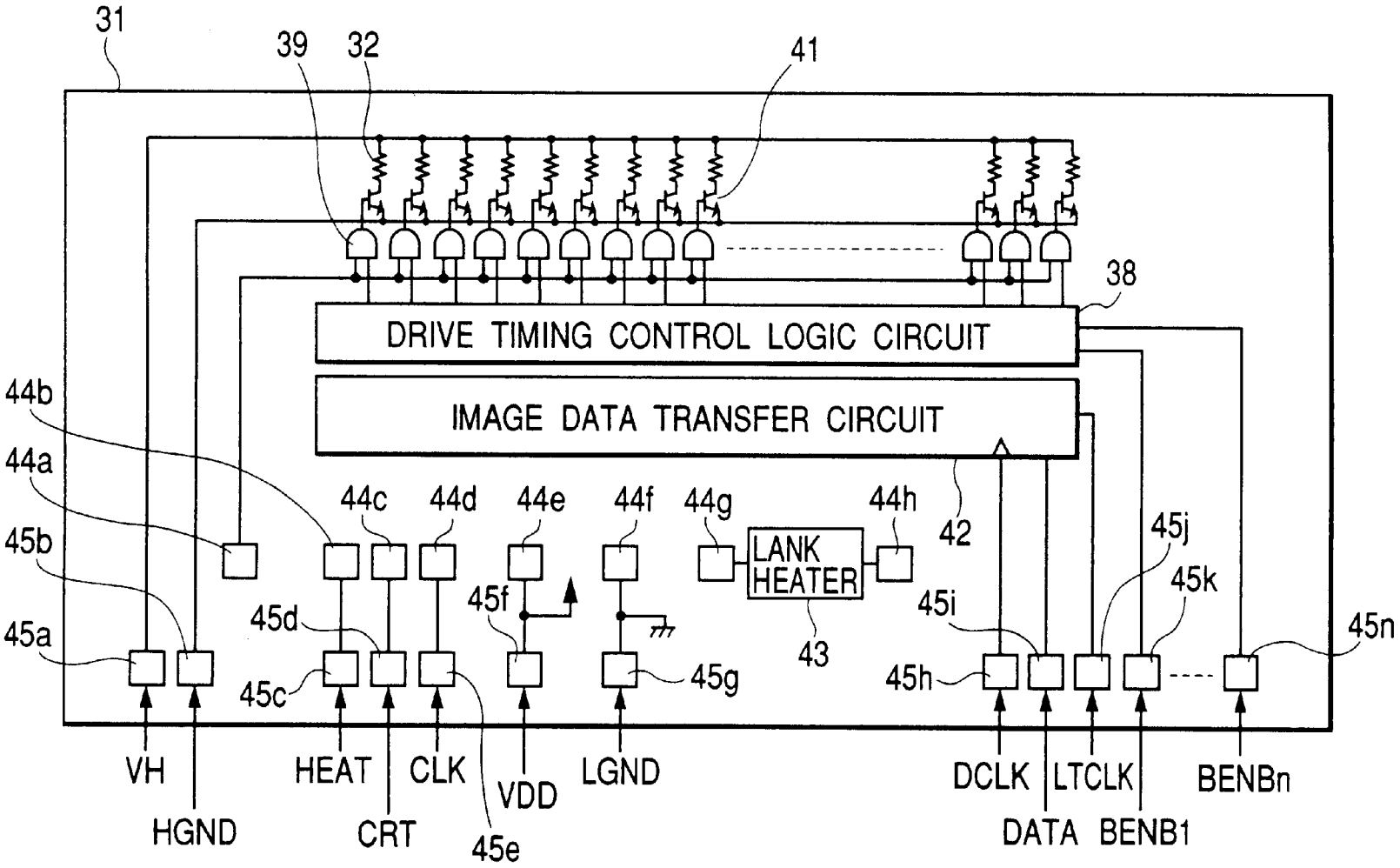
FIGS. 4A and 4B are diagrams showing the circuit constitution of the element substrate and top plate for controlling an energy to be applied to a heater in response to a sensor output.
Figure 4B:
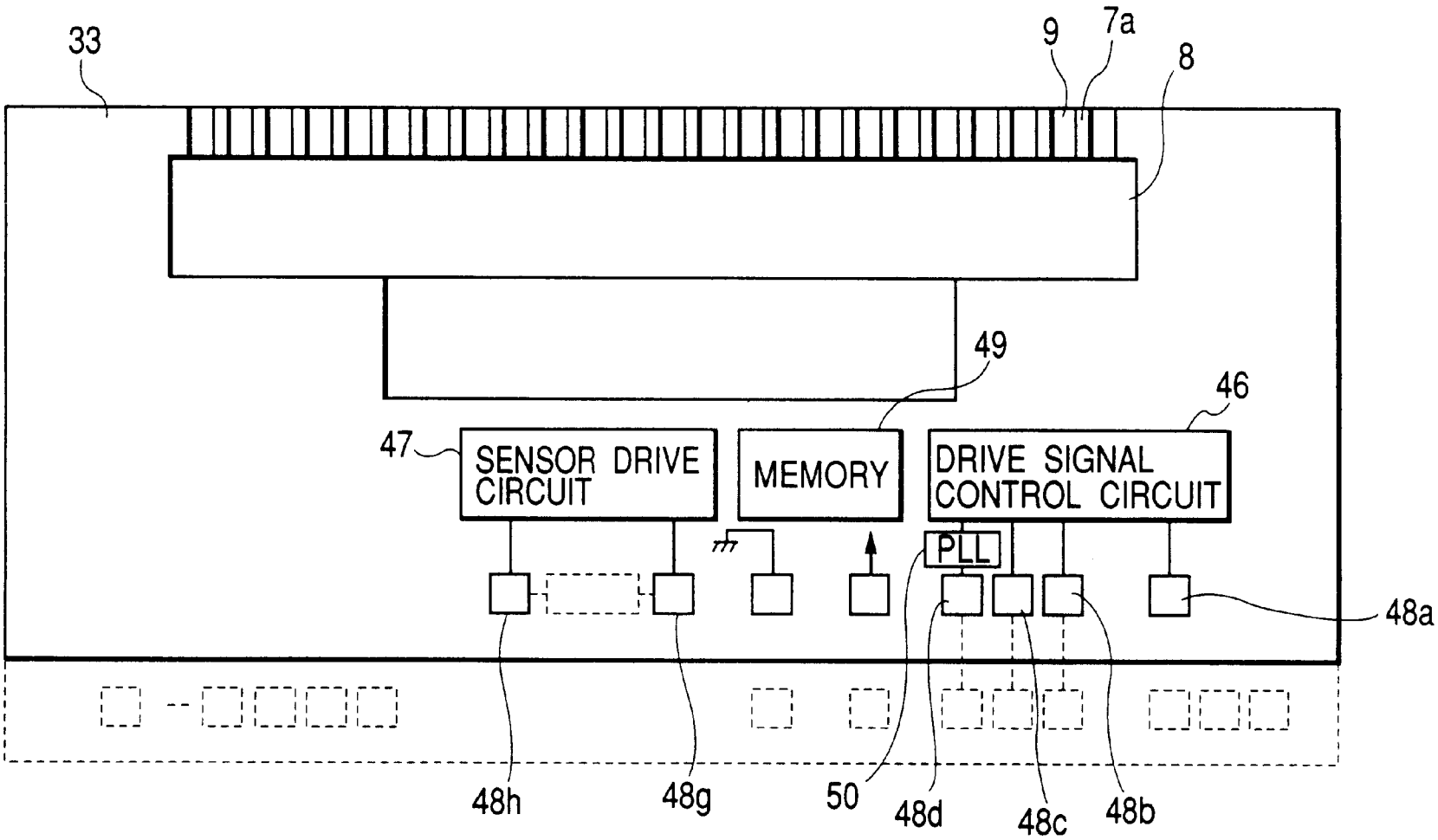

FIGS. 4A and 4B are diagrams showing the circuit constitutions of the element substrate and top plate in which the energy applied to the heater is controlled in accordance with the sensor output.

As shown in FIG. 4A, an element substrate 31 is provided with: heaters 32 arranged in one row; a power transistor 41 functioning as a driver; an AND circuit 39 for controlling the driving of the power transistor 41; a drive timing control logic circuit 38 for controlling the drive timing of the power transistor 41; an image data transfer circuit 42 constituted of a shift register and latch circuit; and a rank heater 43 for detecting the resistivity of the heater 32.

The drive timing control logic circuit 38 divisionally drives and energizes the heaters 32 at deviating times instead of energizing all heaters 32 simultaneously for a purpose of reducing the device power capacity, and the enabling signal (head drive time-sharing signal) for driving the drive timing control logic circuit 38 is inputted via 45*k*, 45*n* as external contact pads.

Moreover, as the external contact pads disposed on the element substrate 31, in addition to the enabling signal input terminals 45*k*, 45*n*, there are a drive power input terminal 45*a* of the heater 32, a ground terminal 45*b* of the power transistor 41, input terminals 45*c*, 45*e* for signals necessary for controlling the energy to drive the heater 32, a logic circuit drive power terminal 45*f*, a ground terminal 45*g*, an input terminal 45*i* of serial data inputted to the shift register of the image data transfer circuit 42, a synchronous input terminal 45*h* of a serial clock signal, and an input terminal 45*j* of a latch clock signal inputted to the latch circuit.

On the other hand, as shown in FIG. 4B, a top plate 33 is provided with: a sensor drive circuit 47 for driving the rank heater 43; a drive signal control circuit 46 for monitoring the output from the rank heater 43 and controlling the energy applied to the heater 32 in accordance with the result; a memory 49 for storing the resistivity data detected by the rank heater 43 or a code value ranked from the resistivity, and pre-measured liquid discharge amount properties by the respective heaters 32 (liquid discharge amount in a predetermined pulse applied at a constant temperature) as head information and outputting the information to the drive signal control circuit 46; and a phase locked loop (PLL) circuit 50 as a period shortening circuit for shortening the period of a reference clock CLK inputted to the drive signal control circuit 46.

Moreover, a the connecting contact pads, the element substrate 31 and top plate 32 are provided with: terminals 44*g*, 44*h*, 48*g*, 48*h* for connecting the rank heater 43 to the sensor drive circuit 47; terminals 44*b* to 44*d*, 48*b* to 48*d* for connecting to the drive signal control circuit 46 the input terminals 45*c* to 45*e* for signals necessary for controlling the energy to drive the heater 32 from the outside; a terminal 48*a* for inputting the output of the drive signal control circuit 46 to one input terminal of the AND circuit 39; and the like.

Figure 5:
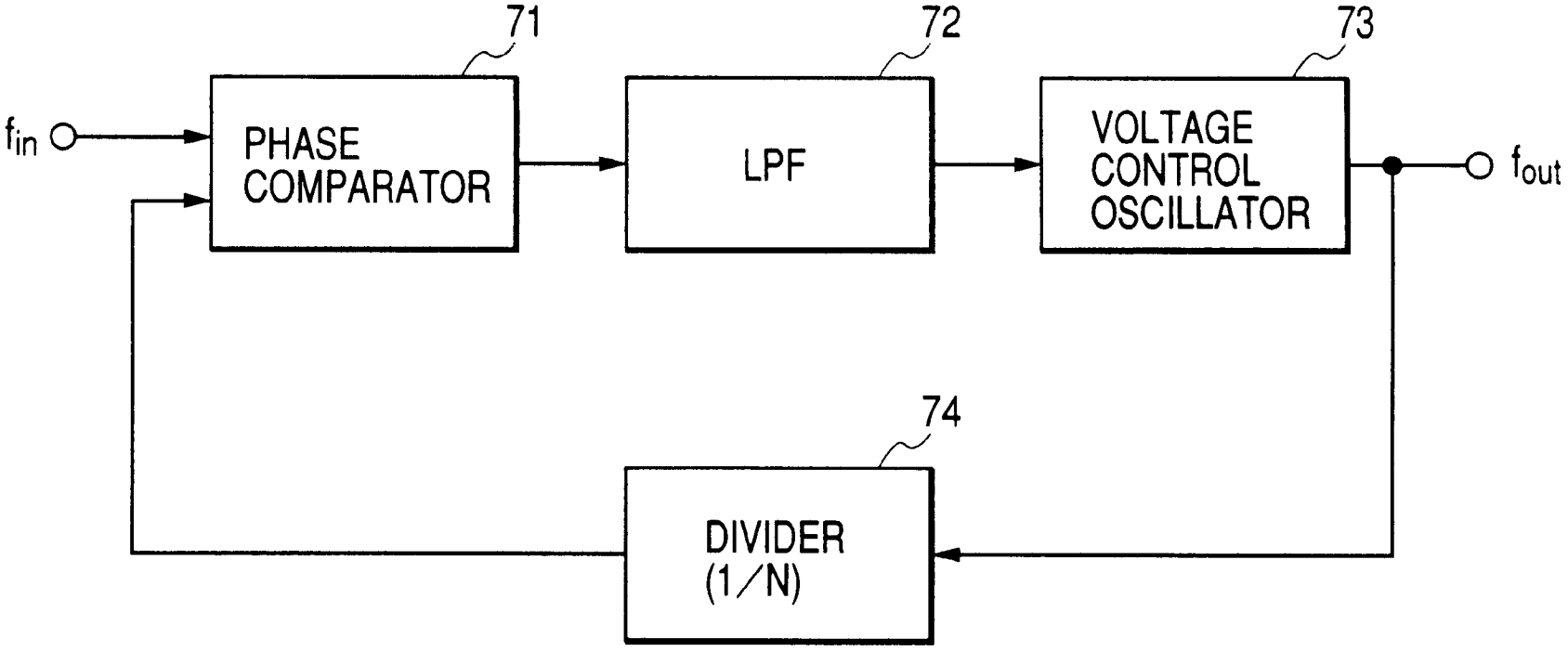
FIG. 5 is a block diagram showing one constitution example of a PLL circuit shown in FIGS. 4A and 4B.

For example, as shown in FIG. 5, the PLL circuit 50 is constituted of: a phase comparator 71 for detecting the phase difference of two inputted signals; a low pass filter (LPF) 72 for smoothing the output pulse of the phase comparator 71; a voltage control oscillator (VCO) 73 for outputting the pulse signal of a frequency proportional to the output voltage of the low pass filter 72; and a divider 74 for dividing the frequency of the output pulse of the voltage control oscillator 73.

Since the PLL circuit shown in FIG. 5 operates so that two signal phases (frequencies) inputted to the phase comparator 71 agree with each other, the pulse signal with the frequency (1/N period) N times that of the input signal determined by the division ratio (1/N) of the divider 74 can be obtained from the voltage control oscillator 73.

The PLL circuit 50 is inserted between the terminal 48*d* and the drive signal control circuit 46, and sets the period of the reference clock CLK inputted via the terminals 48*d*, 44*d* by a factor of 1/N. Additionally, the drive signal control circuit 46 may operate using a clock DCLK for transferring the image data, and also in this case, the period of the clock DCLK is set by the factor of 1/N by the PLL circuit 50 and inputted to the drive signal control circuit 46.

Figure 6:
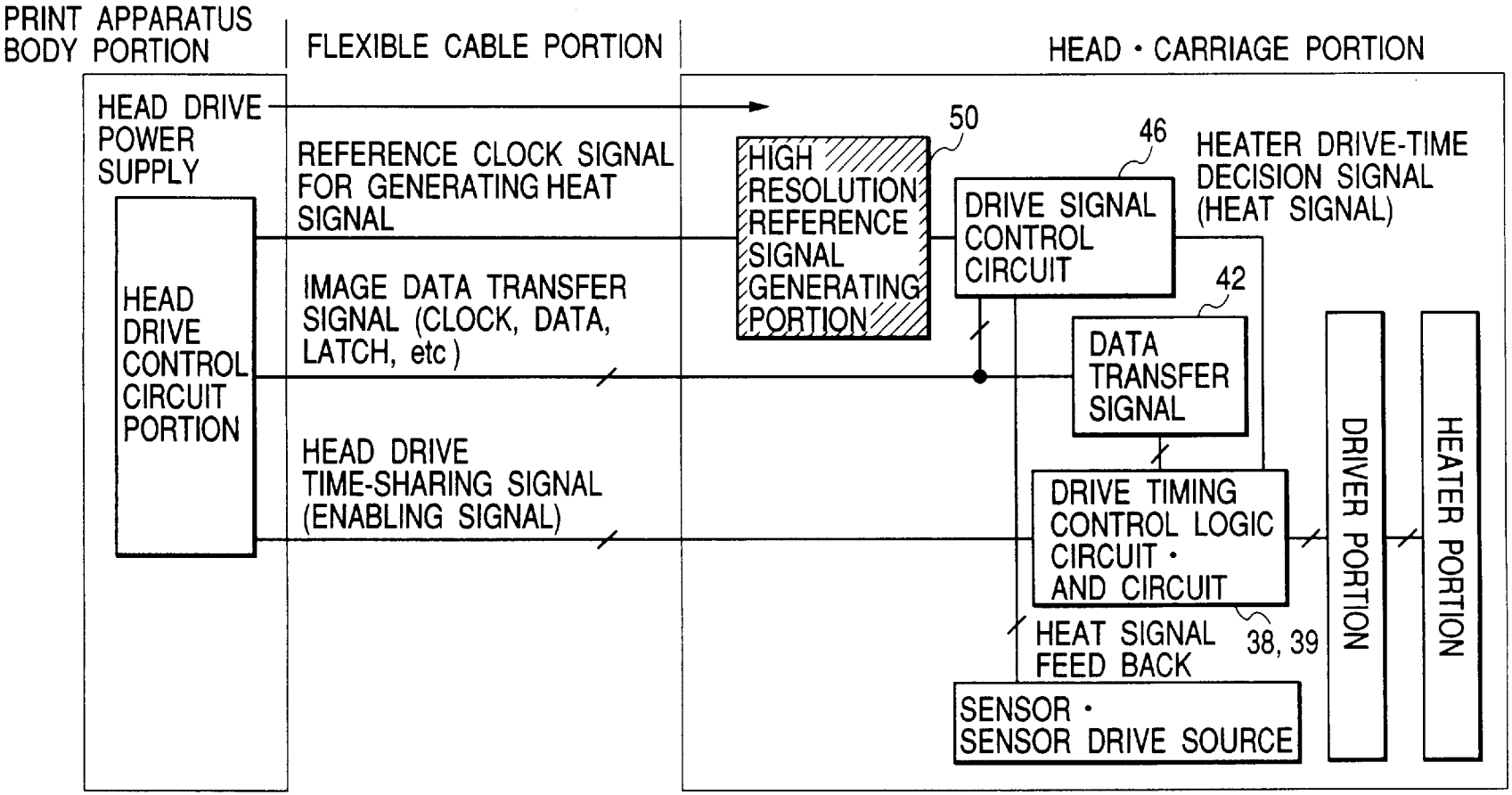
FIG. 6 is a block diagram showing a signal flow according to a first embodiment.

A signal flow in the above-described constitution will be described. FIG. 6 is a signal flow diagram of the present embodiment.

First, in the device main body, a head drive control circuit portion generates the reference input signal for use in generating a heat signal, an image data transfer signal for use in transferring image data such as DCLK, DATA and LATCH, and a head drive time-sharing signal ($BENB_{1\ to\ n}$), and outputs these signals to a head side.

Among these signals, the reference input signal is inputted to the high resolution reference signal generating portion 50 before inputted to the drive signal control circuit 46, and the clock signal CLK provided with a high resolution is generated from the reference input signal. The drive signal control circuit 46 performs correction by the information from the sensor stored in the memory 49 based on the clock signal provided with the high resolution and some of the image data transfer signals, generates a heater drive-time decision signal, and outputs this heater drive-time decision signal to the drive timing control circuit 38 and AND circuit 39.

On the other hand, the image data transfer signal including the serially inputted image data is inputted to the image data transfer circuit 42, and outputted as the latched image data to the drive timing control circuit 38 and AND circuit 39. Furthermore, head drive time-sharing signals are inputted to the drive timing control circuit 38 and AND circuit 39, and a discharging heater is driven by these signals.

Specifically, the resistivity of the heater 32 is detected by the rank heater 43, and the result is stored in the memory 49. The drive signal control circuit 46 decides the rising and falling data of the drive pulse signal of the heater 32 in accordance with the resistivity data and liquid discharge amount property stored in the memory 49, and outputs the data to the AND circuit 39 via the terminals 48*a*, 44*a*. On the other hand, the serially inputted image data is stored in the shift register of the image data transfer circuit 42, latched in the latch circuit by the latch signal, and outputted to the AND circuit 39 via the drive timing control circuit 38. Therefore, the pulse width of the heat pulse is determined in accordance with the rising and falling data, and the heater 32 is energized with this pulse width. As a result, the substantially constant energy is applied to the heater 32.

Here, in the present embodiment, since the PLL circuit 50 sets the period of the reference clock CLK for operating the drive signal control circuit 46 by the factor of 1/N, the drive pulse signal for the ink jet recording head provided with the accelerated speed and a multiplicity of nozzles can be generated with the high resolution and good precision.

As described above, the reference clock CLK is transmitted to the ink jet recording head mounted on the carriage from the main body device of the ink jet recording device via the cable of the flexible substrate or the like. In the present embodiment, even in the ink jet recording head provided with the accelerated speed and the multiplicity of nozzles, the frequency of the reference clock CLK is of the order of 1 MHz to 10 MHz similarly as the conventional art, the unnecessary radiation noise generated from the cable can be reduced, the pulse waveform bluntness is minimized and the malfunction of the ink jet recording head is prevented.

Figure 7:
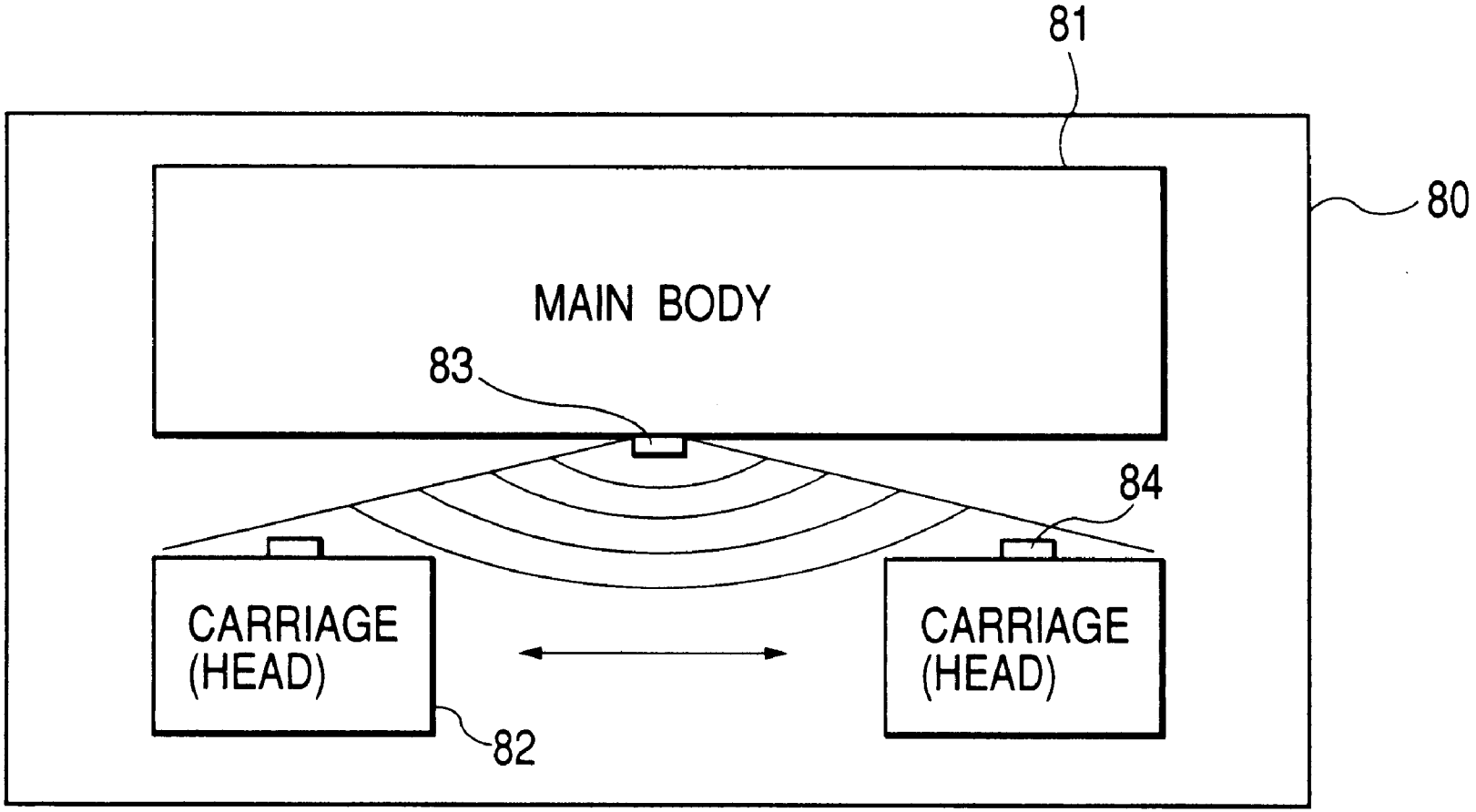
FIG. 7 is a plan view showing the constitution of an ink jet recording device according to one embodiment of the present invention.

Moreover, since the frequency of the reference clock CLK transmitted to the ink jet recording head by the above-described constitution is of the same degree as in the conventional constitution, as shown in FIG. 7, the reference clock can also be transmitted by radiating signal light to an optical data receiver 84 of a carriage 82 with the ink jet recording head mounted thereon from an optical data transmitter 83 of a main body 81. In this case, an ink jet recording device 80 in which the pulse waveform bluntness and radiation noise are reduced can be obtained. Additionally, the optical data receiver 84 may be disposed on the ink jet recording head instead of the carriage 82.

Moreover, even in a constitution in which a heating element or a piezoelectric element is disposed in each liquid channel in order to control the position of a meniscus formed in the discharge port, the ink discharge amount can be controlled with high precision by using the clock whose period is set by the factor of 1/N by the PLL circuit 50 and generating the drive pulse signal.

Additionally, the memory 49 and PLL circuit 50 may be disposed on the element substrate 31, not on the top plate 33, if there is a space on the side of the element substrate 31. In order to solve the problem, the clock period may be shortened by disposing the PLL circuit 50 on the substrate different from the element substrate, or in the carriage which also moves with the ink jet recording head, although the component cost and mounting cost slightly increase.

As described above, even when the driving of the heater 32 is controlled to obtain a satisfactory image grade, the bubble is generated in the common liquid chamber. When the bubble moves in the liquid channel with the refilling with the liquid, there occurs a disadvantage that no liquid is discharged although the liquid is present in the common liquid chamber.

To cope with this problem, as not detailed, a sensor for detecting the presence/absence of the liquid in the respective liquid channels (particularly in the vicinity of the heater 32) may be disposed, and further a processing circuit for outputting the result to the outside when the sensor detects the absence of the liquid may be disposed on the top plate 33. Moreover, by forcibly sucking the liquid in the head from the discharge port on the side of the ink jet recording device based on the output from the processing circuit, the bubble in the liquid channel can be removed. As the sensor for detecting the presence/absence of the liquid, a sensor for detection by a change of resistivity via the liquid, or a sensor for detecting the abnormal temperature rise of the heater when no liquid is present can be used.

Example of Element Substrate Temperature Control

Figure 15A:
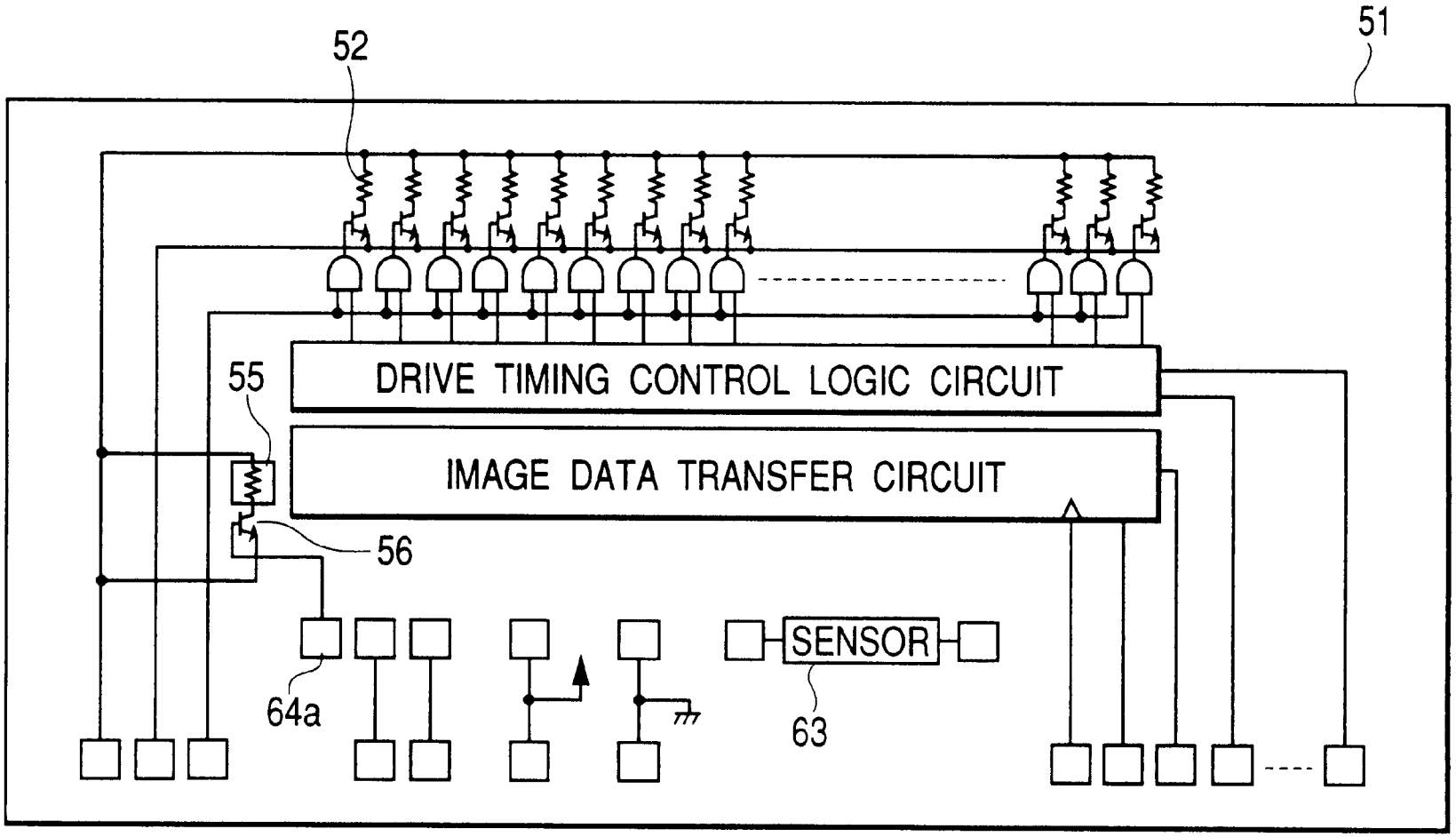
FIGS. 15A and 15B are diagrams showing the circuit constitution of the element substrate and top plate for controlling an element substrate temperature in response to the sensor output.
Figure 15B:
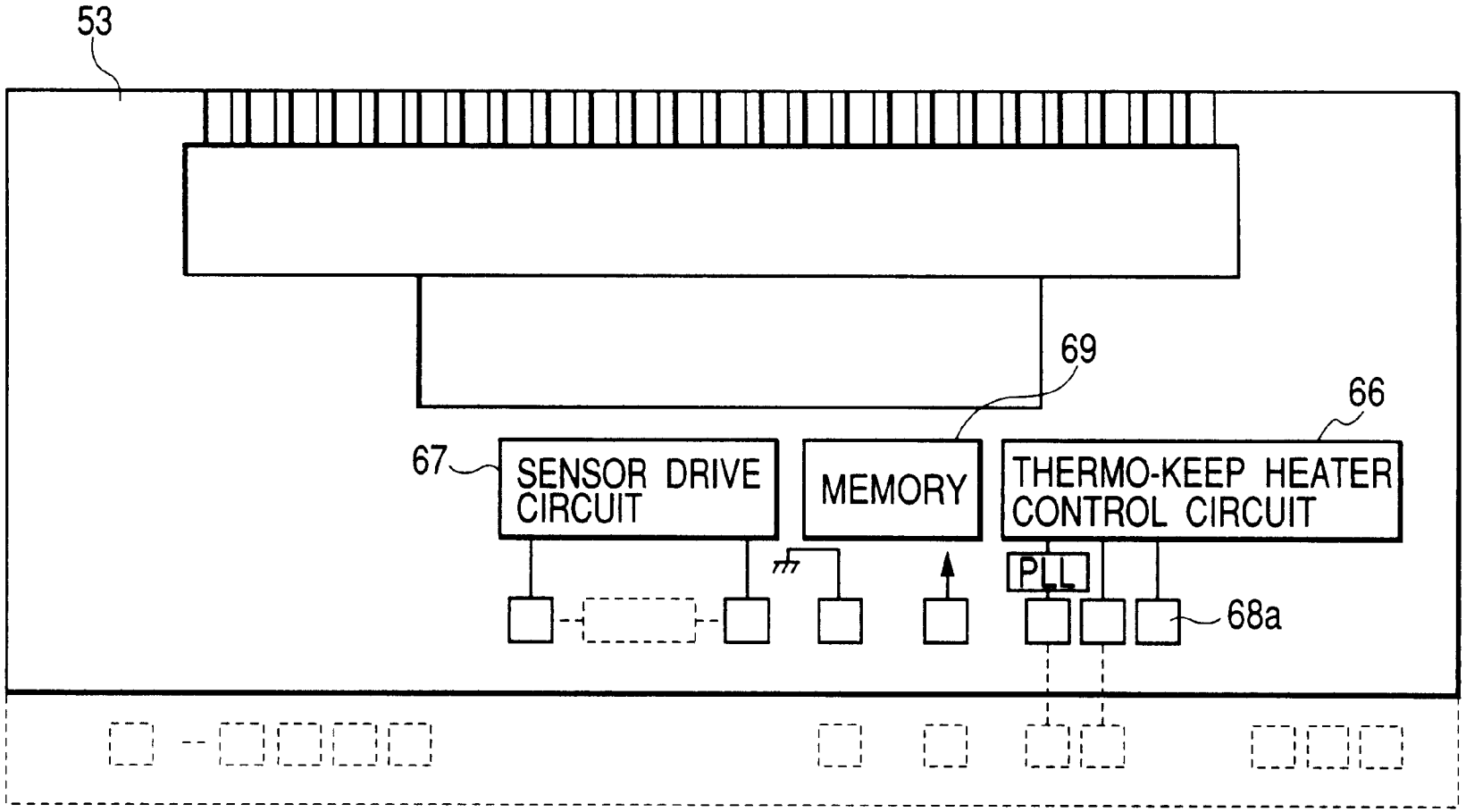

FIGS. 15A and 15B are diagrams showing the circuit constitutions of the element substrate and top plate in which the temperature of the element substrate is controlled in response to the sensor output.

In this example, as shown in FIG. 15A, in addition to a heater 52 for discharging the liquid, for an element substrate 51, a temperature heater 55 for heating the element substrate 51 itself to adjust the temperature of the element substrate 51 as the discharge amount control element for controlling the ink discharge amount, and a power transistor 56 as the driver of the temperature heater 55 are added to the element substrate 31 shown in FIG. 4A. Moreover, a temperature sensor for measuring the temperature of the element substrate 51 is used as a sensor 63.

On the other hand, as shown in FIG. 15B, a top plate 53 is provided with a sensor drive circuit 67 for driving the sensor 63, a memory 69 for storing the liquid discharge amount property, and additionally a temperature heater control circuit 66 for monitoring the output from the sensor 63 and controlling the driving of the temperature heater 55 in accordance with the result. The temperature heater control circuit 66 includes a comparator, compares a threshold value predetermined based on the temperature required for the element substrate 51 with the output from the sensor 63, and outputs a temperature heater control signal for driving the temperature heater 55 when the output from the sensor 63 is larger than the threshold value. The temperature required for the element substrate 51 is a temperature at which the viscosity of the liquid in the ink jet recording head is in a stable discharge range. Moreover, terminals 64*a*, 68*a* for inputting a temperature heater control signal outputted from the temperature heater control circuit 66 to the temperature heater power transistor 56 formed on the element substrate 51 are disposed as the connecting contact pads on the element substrate 51 and top plate 53. The other constitution is similar to the constitution shown in FIGS. 4A and 4B.

According to the above-described constitution, the temperature heater 55 is driven by the temperature heater control circuit 66 and the temperature of the element substrate 51 is kept at a predetermined temperature in accordance with the output result of the sensor 63. As a result, the liquid viscosity in the ink jet recording head is kept in the stable discharge range, and a satisfactory discharge is possible. Moreover, since the period of the reference clock for operating the temperature heater control circuit 66 is shortened by the PLL circuit similarly as the constitution shown in FIGS. 4A and 4B, the drive pulse signal of the temperature heater 55 can be generated with a high resolution, and a higher precision temperature control is possible.

Additionally, the sensor 63 has an output value dispersion by a solid difference. Furthermore, when an accurate temperature adjustment is to be performed, the dispersion may be corrected by storing the correction value of the output value dispersion as head information in the memory 69, and adjusting the threshold value set in the temperature heater control circuit 66 in accordance with the correction value stored in the memory 69. Additionally, in the embodiment shown in FIG. 1, the groove for constituting the liquid channel 7 is formed in the top plate 3, and the member (orifice plate 4) provided with the discharge port 5 is constituted by the member different from those of the element substrate 1 and top plate 3, but the structure of the ink jet recording head to which the present invention is applied is not limited to this.

For example, when a wall is left in the end surface of the top plate for the thickness of the orifice plate, and the discharge port is formed in the wall by an ion beam treatment, an electron beam treatment, or the like, the ink jet recording head can be constituted without using the orifice plate. Moreover, when a channel side wall is formed on the element substrate instead of forming the groove in the top plate, the position precision of the liquid channel with respect to the heater is enhanced, and a top plate shape can be simplified. The movable member can be formed on the top plate utilizing the photolithography process, but when the element substrate is provided with the channel side wall, the element substrate can be formed at the same time when the movable member is formed on the element substrate.

The ink presence/absence detection using the temperature sensor and the head drive operation in accordance with the detected result will next be described with reference to FIGS. 16A and 16B to 20A and 20B.

FIGS. 16A and 16B to 20A and 20B are schematic explanatory views showing the modification examples of the circuit constitution of the element substrate and top plate of the ink jet recording head of the present invention, and drawings A are plan views showing the element substrate and drawings B are plan views showing the top plate. These drawings A and B show opposite faces similarly as FIGS. 2A and 2B, and a dotted line in each drawing B shows the position of a liquid chamber and channel when the top plate is bonded to the element substrate.

Additionally, in the structure example of the head shown in FIGS. 16A and 16B to 20A and 20B, an element substrate 401 is provided with a channel wall 401*a*, but the structure of the element substrate and top plate can be applied to any one of the above-described embodiments. Moreover, unless not particularly mentioned in the following description, needless to say, the combination of the respective embodiments shown in FIGS. 16A and 16B to 20A and 20B is also included in the present invention. Additionally, in the following description, the part provided with the common function will be described using the same reference numerals.

Figure 16A:
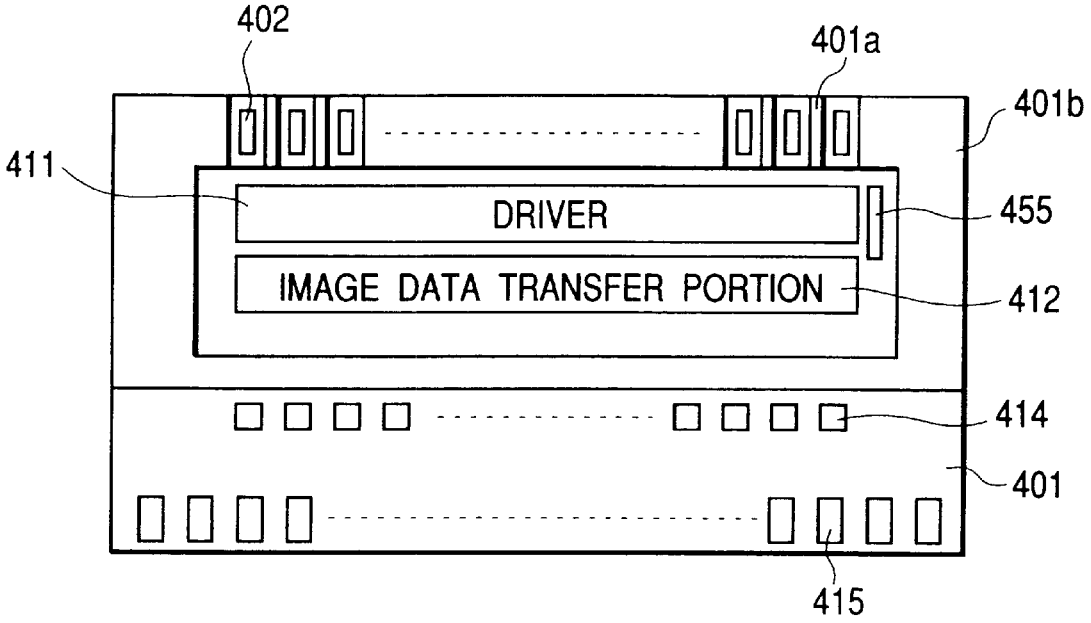
FIGS. 16A and 16B are diagrams showing the circuit constitution of the element substrate and top plate for utilizing the output of a temperature sensor and detecting the presence/absence of ink.

In FIG. 16A, the element substrate 401 is provided with a plurality of heaters 402 arranged in parallel for channels as described above, a sub heater 455 disposed in a common liquid chamber, a driver 411 for driving these heaters 402 in accordance with image data, an image data transfer portion 412 for outputting the inputted image data to the driver 411, the channel wall 401*a* for forming a nozzle, and a liquid chamber frame 401*b* for forming the common liquid chamber.

Figure 16B:
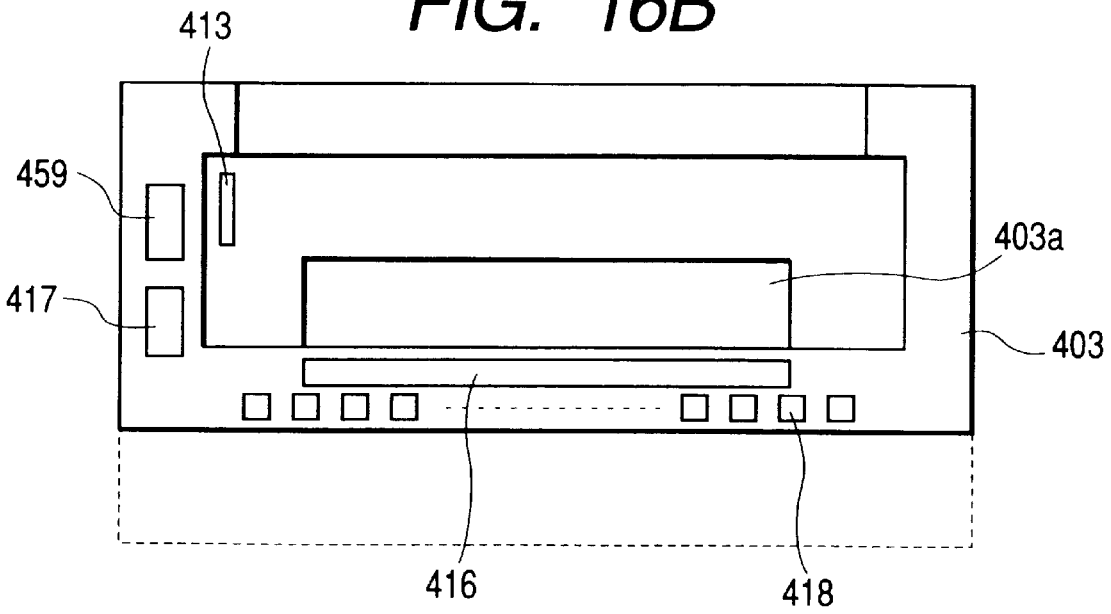

On the other hand, in FIG. 16B, a top plate 403 is provided with a temperature sensor 413 for measuring the temperature in the common liquid chamber, a sensor driver 417 for driving the temperature sensor 413, a limitation circuit 459 for limiting or stopping the driving of the heater resistance element based on the output of the temperature sensor, and a heater controller 416 for controlling the drive condition of the heater 402 based on the signals of the sensor driver 417 and limitation circuit 459, and additionally a supply port 403*a* communicating with the common liquid chamber is opened to supply the liquid to the common liquid chamber from the outside.

Furthermore, the opposite sites of the bonded faces of the element substrate 401 and top plate 403 are provided with connecting contact pads 414, 418 for electrically connecting the circuits formed on the element substrate 401 to the circuits formed on the top plate 403. Moreover, the element substrate 401 is provided with external contact pads 415 as the input terminals of the electric signals from the outside. The size of the element substrate 401 is larger than that of the top plate 403, and the external contact pads 415 are disposed in positions which are exposed from the top plate 403 when the element substrate 401 is bonded to the top plate 403.

When the element substrate 401 and top plate 403 constituted as described above are positioned and bonded, the heaters 402 are disposed for the respective liquid channels, and the circuits, and the like formed on the element substrate 401 and top plate 403 are electrically connected via the respective connecting contact pads 414, 418.

A space of several tens of micrometers is filled with the ink between a first substrate (element substrate 401) and a second substrate (top plate 403). Therefore, when the heating is performed by the sub heater 455, a difference is produced in the way of heat conduction to the second substrate by the presence/absence of the ink. Therefore, when the heat conduction difference is detected by the temperature sensor 413 constituted of a diode sensor utilizing PN bonding, and the like, the presence/absence of the ink in the liquid chamber can be detected. For example, in accordance with the detected result by the temperature sensor 413, when the temperature sensor 413 detects the abnormal temperature as compared with the presence of the ink, the limitation circuit 459 limits or stops the driving of the heater 402, and a signal indicative of the abnormality is outputted to the main body. Therefore, there can be provided a head which prevents the physical damage of the head, and constantly fulfills a stable discharge performance.

Particularly, in the present invention, since the temperature sensor and limitation circuit can be manufactured by the semiconductor wafer process, the element can be disposed in an optimum position, and a head damage preventing function can be added without increasing the cost of the head itself.

Figure 17A:
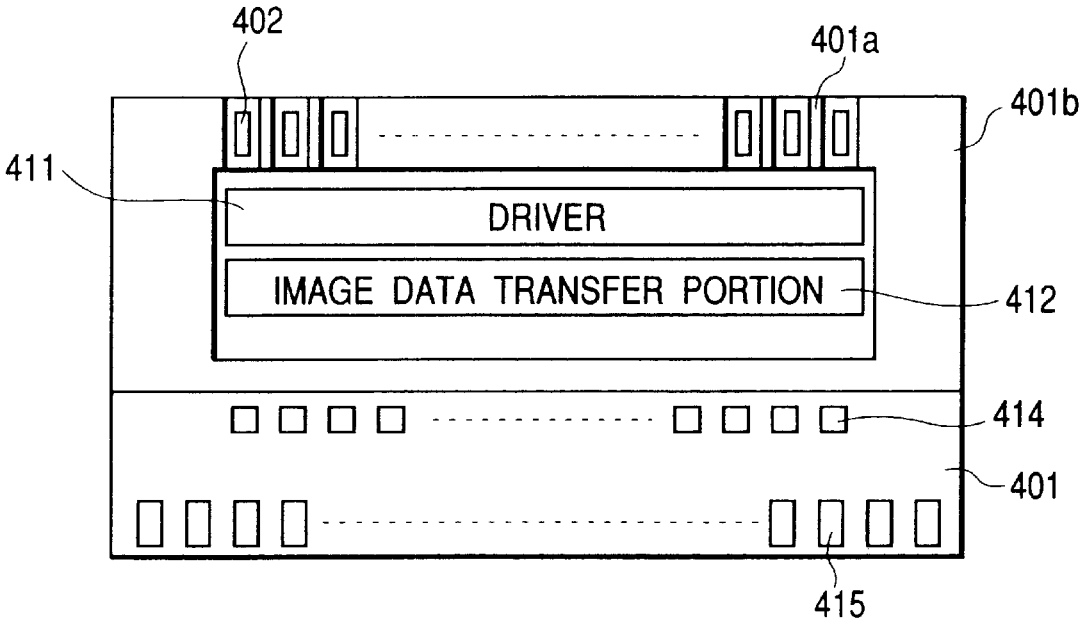
FIGS. 17A and 17B are diagrams showing the modification example of the circuit constitution of the element substrate and top plate shown in FIGS. 16A, 16B.
Figure 17B:
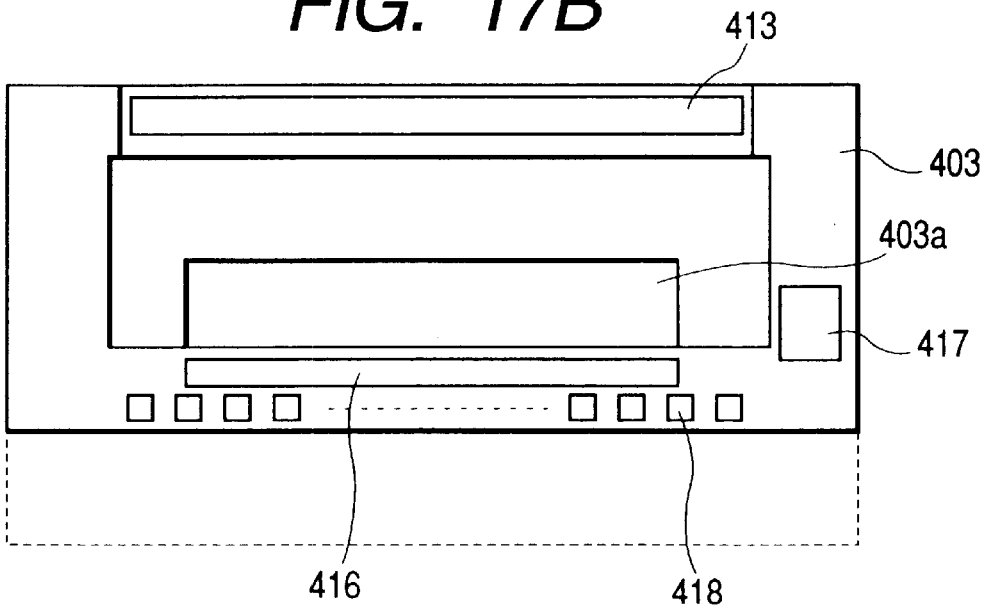

FIGS. 17A and 17B are explanatory views showing the modification example of FIGS. 16A and 16B. The modification example shown in FIGS. 17A and 17B are different from that of FIGS. 16A and 16B in that a discharging heater, that is, the heater 402 is used instead of the sub heater. In the modification example shown in FIGS. 17A and 17B, the temperature sensor 413 is disposed in an area on the top plate 403 disposed opposite to the heater 402, and the ink presence/absence is detected by detecting the temperature at which the driving is performed with a short pulse of a level at which the heater 402 is not foamed or with a low voltage. In addition to the detection of the ink presence/absence, the temperature can be monitored by performing the liquid discharging operation, and fed back to the driving. The constitution of the present modification example is particularly effective when it is difficult to dispose the sub heater in the common liquid chamber. Moreover, in the present modification example, the heater controller 416 limits or stops the head driving based on the output of the temperature sensor 413.

Figure 18A:
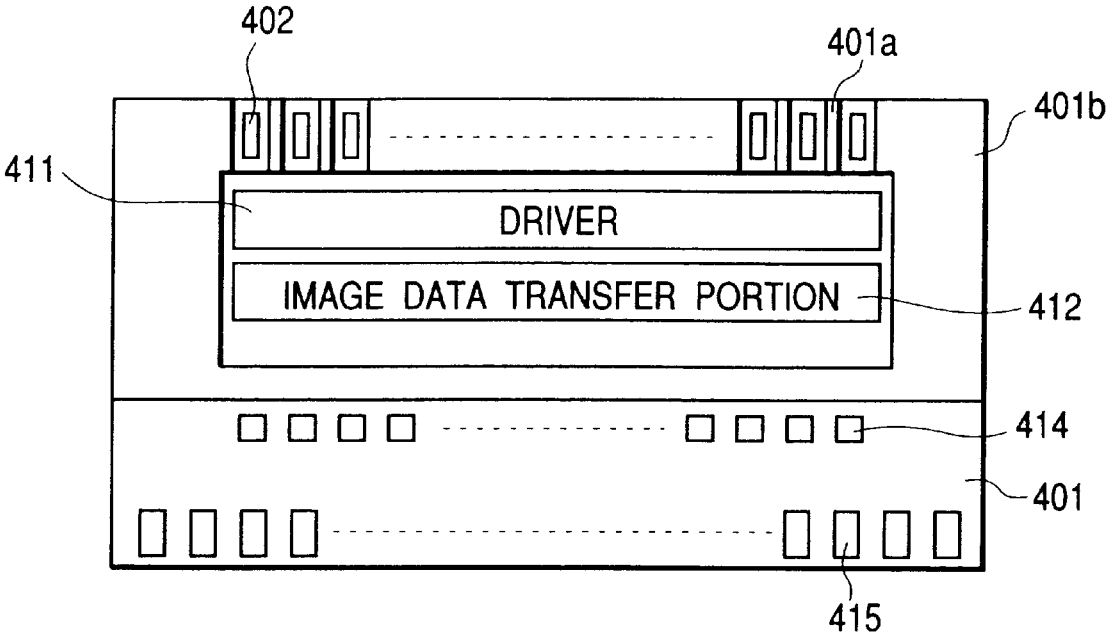
FIGS. 18A and 18B are diagrams showing the modification example of the circuit constitution of the element substrate and top plate shown in FIGS. 16A, 16B.
Figure 18B:
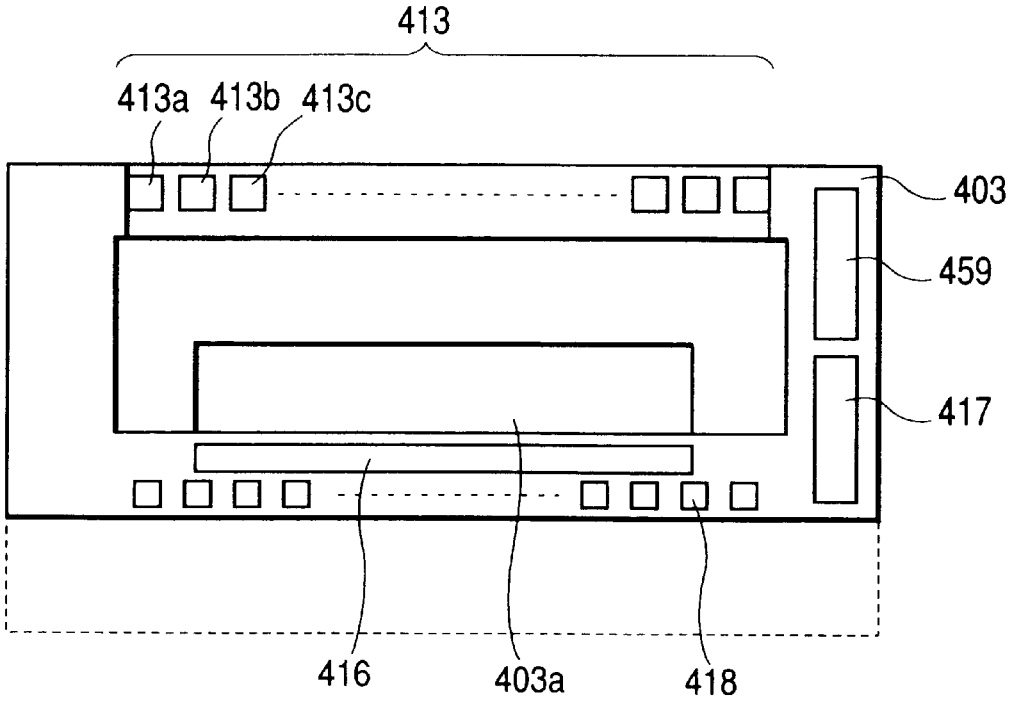

The modification example shown in FIGS. 18A and 18B are different from that shown in FIGS. 17A and 17B in that the temperature sensor 413 is disposed to form a plurality of groups for the different heaters 402 (in the drawing, 413*a*, 413*b*, 413*c* . . . correspond to individual nozzles). Since the heaters 402 can selectively be driven, by disposing a plurality of temperature sensors, the ink state, such as the ink presence/absence in a finer part, can be detected.

Furthermore, since the temperature sensors are disposed to establish the one-to-one correspondence with the respective heaters 402 as in the present embodiment, the temperature change during the liquid discharge can be detected by nozzle unit, and the ink presence/absence in the nozzle, and further the foamed state can be detected by the temperature. The detection of a partial non-discharge by the ink shortage of each nozzle may be performed by disposing a memory as shown in FIGS. 20A and 20B and comparing the data with the data for the normal discharge held in the memory, or by comparing the data with the data of a plurality of adjacent nozzles (for example, when an abnormal output is made only for 413*b* among 413*a*, 413*b*, 413*c*, . . . , abnormality is judged with respect to 413*b*).

Additionally, in this case, since the respective temperature sensors 413*a*, 413*b*, 413*c*, . . . do not correspond to the heaters 402 via the electric wiring connection, there are no problems such as complicated wiring even when the temperature sensors are disposed on the top plate 403. Moreover, even when a plurality of sensors are disposed, the manufacture is performed by the semiconductor wafer process as in the present invention, so that no cost rise is caused. Therefore, this example is particularly preferably employed in a full line head described later.

Figure 19A:
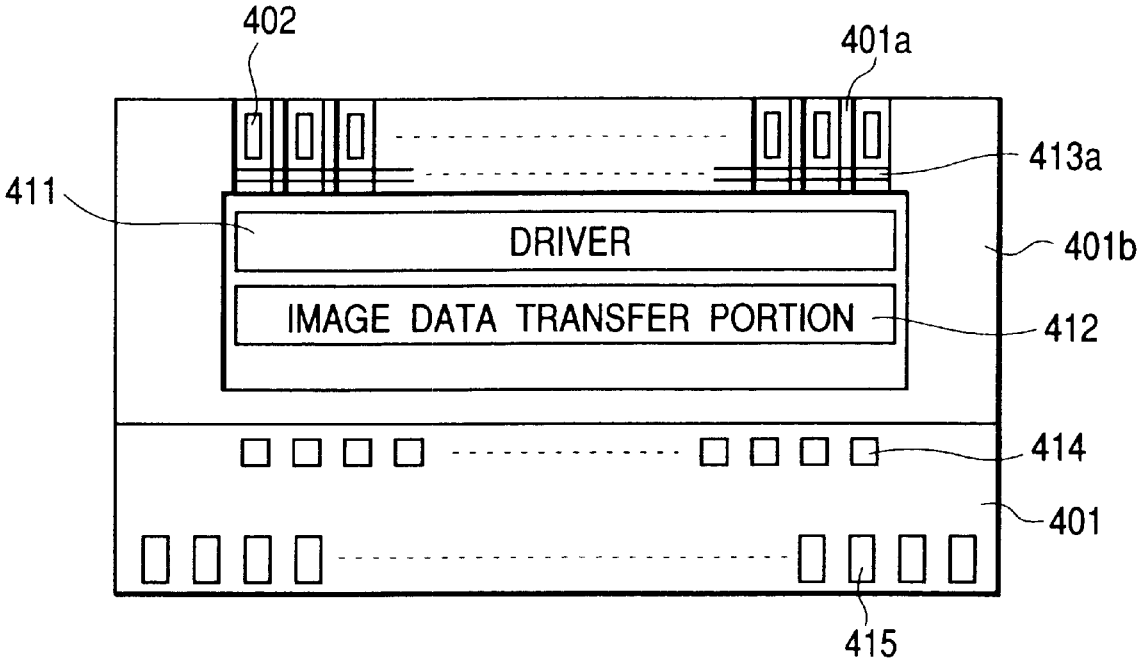
FIGS. 19A and 19B are diagrams showing the modification example of the circuit constitution of the element substrate and top plate shown in FIGS. 16A, 16B.
Figure 19B:
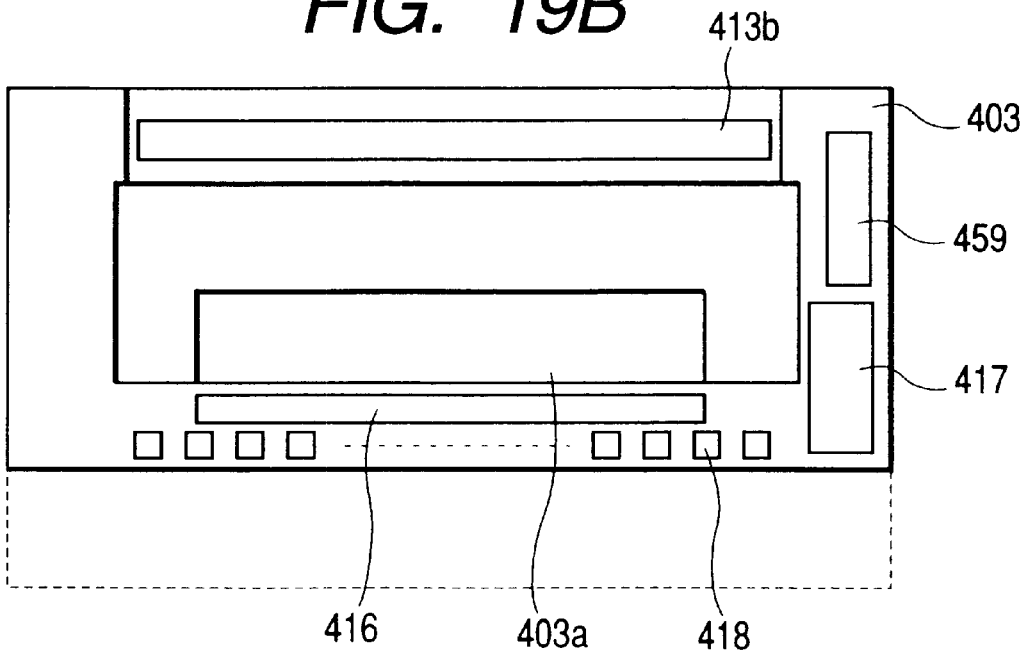

The modification example shown in FIGS. 19A and 19B are different from the modification example shown in FIGS. 17A and 17B in that both the element substrate 401 and top plate 403 are provided with the temperature sensors 413*a*, 413*b*. When the temperature sensor is disposed only on either one substrate, the threshold value indicating the ink presence/absence changes by an outside air temperature and head state (for example, immediately after the print end), and it becomes difficult to perform the control. However, by measuring a temperature rise difference between two sensors during heating, the ink state such as the ink presence/absence can advantageously be detected more easily and accurately as compared with when the sensor is disposed only one substrate.

Figure 20A:
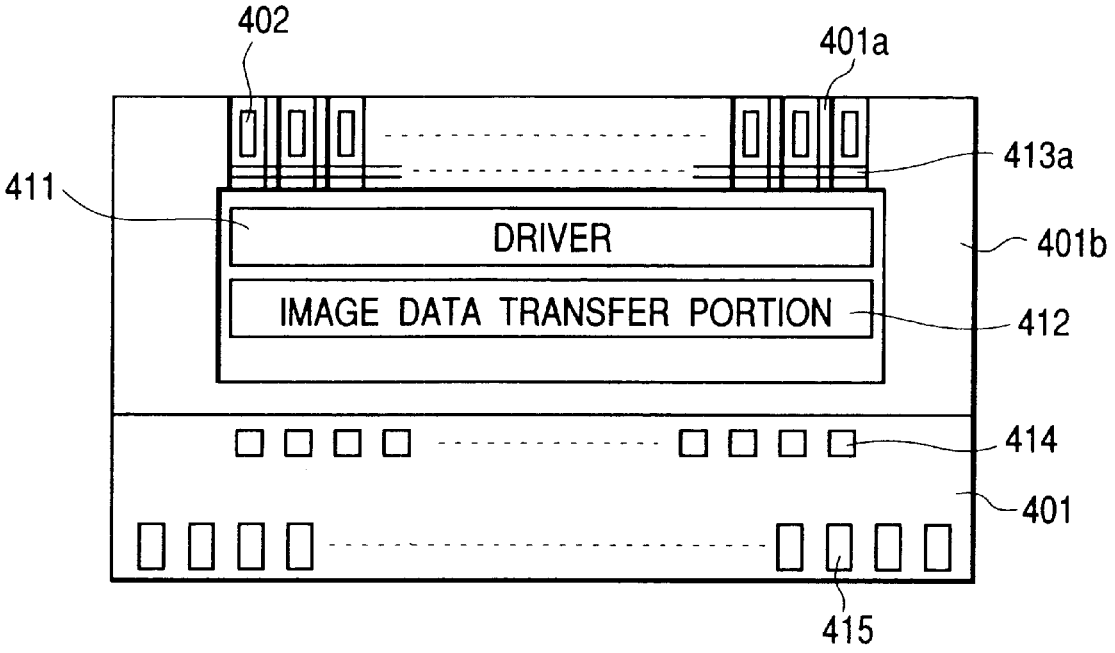
FIGS. 20A and 20B are diagrams showing the modification example of the circuit constitution of the element substrate and top plate shown in FIGS. 16A, 16B.
Figure 20B:
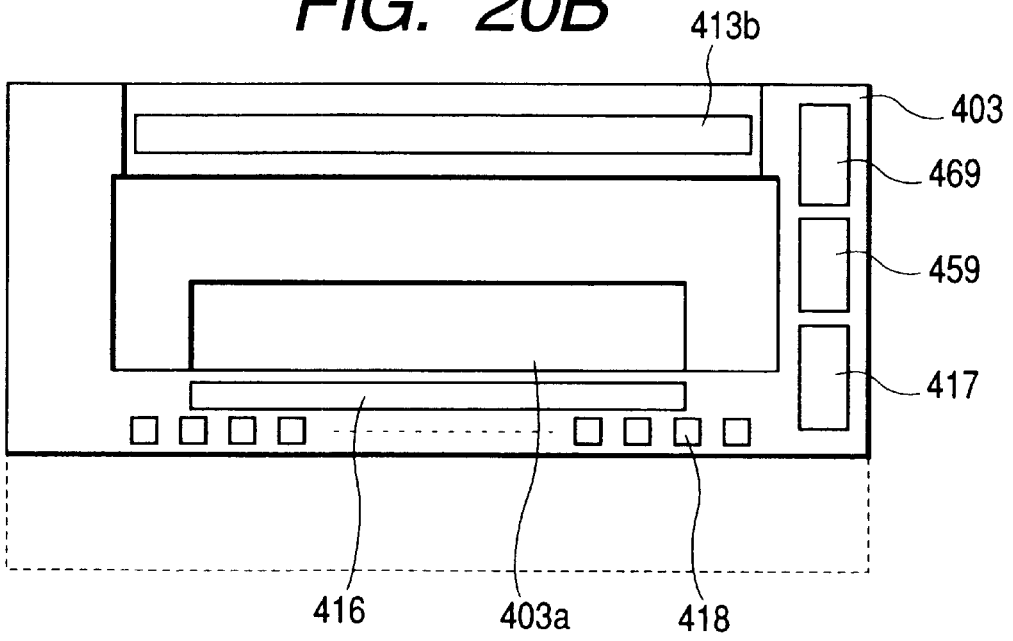

The modification example shown in FIGS. 20A and 20B are different from the modification example shown in FIGS. 19A and 19B in that a memory 469 is disposed for storing the temperature change during the heating of the heating resistance element for the absence and presence of the ink in the head manufacture process as head information and outputting the information to the heater controller 416. By disposing the memory 469 and comparing the value of the memory 469 with the output of the sensor, a higher precision detection of ink presence/absence can be performed.

Of course, as described in the above embodiment, the memory may hold the pre-measured liquid discharge amount property by the respective heaters 402 (the liquid discharge amount in the predetermined pulse applied at the constant temperature) or the head information such as the ink for use.

The point of the present invention developed from the basic constitution has been described above, but in the present invention, the reference signal from the print apparatus main body does not have to be requested individually, or the signal generated from the reference input signal does not have to be limited to the heat signal (heater drive-time decision signal). The example will be describe hereinafter.

(Second Embodiment)

Figure 8:
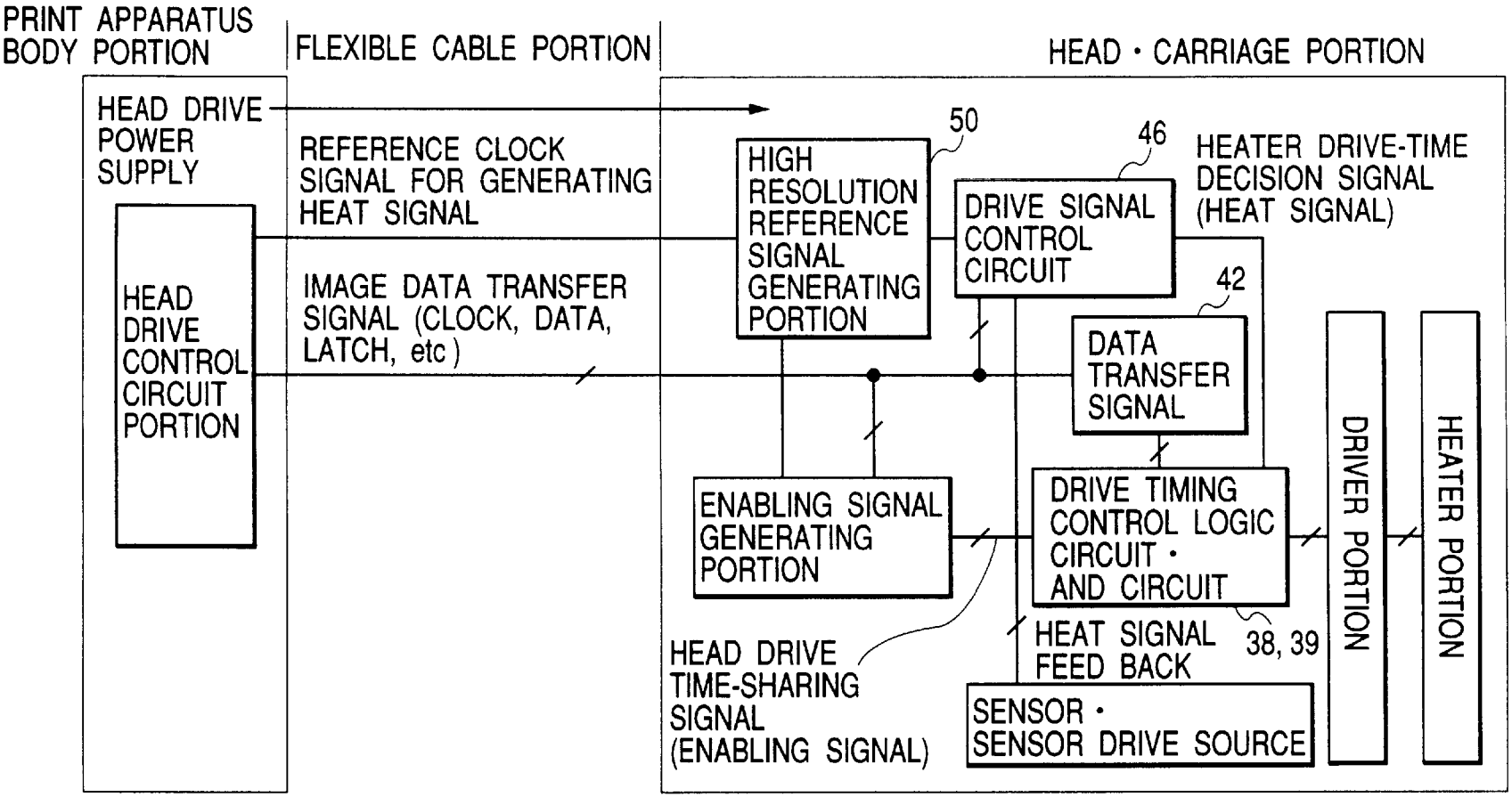
FIG. 8 is a block diagram showing the signal flow of a second embodiment.

FIG. 8 is a signal flow diagram showing a second embodiment of the present invention.

The description of the part common with that of FIG. 6 is omitted.

In the present embodiment, the enabling signal is generated from the high resolution reference signal and image data transfer signal in the enabling signal generator. In the present embodiment, since the enabling signal does not have to be supplied from the outside, there can be produced an effect that the number of signal lines can be reduced. Additionally, in FIG. 8, the data transfer signal is used to obtain heat pulse information, but the head includes non-volatile memories such as EEPROM, and a constitution for controlling the memory may be added. Moreover, the high resolution reference signal inputted to the enabling signal generator does not have to be necessarily the same as the high resolution reference signal inputted to the drive signal control circuit as long as they are synchronous with each other.

(Third Embodiment)

Figure 9:
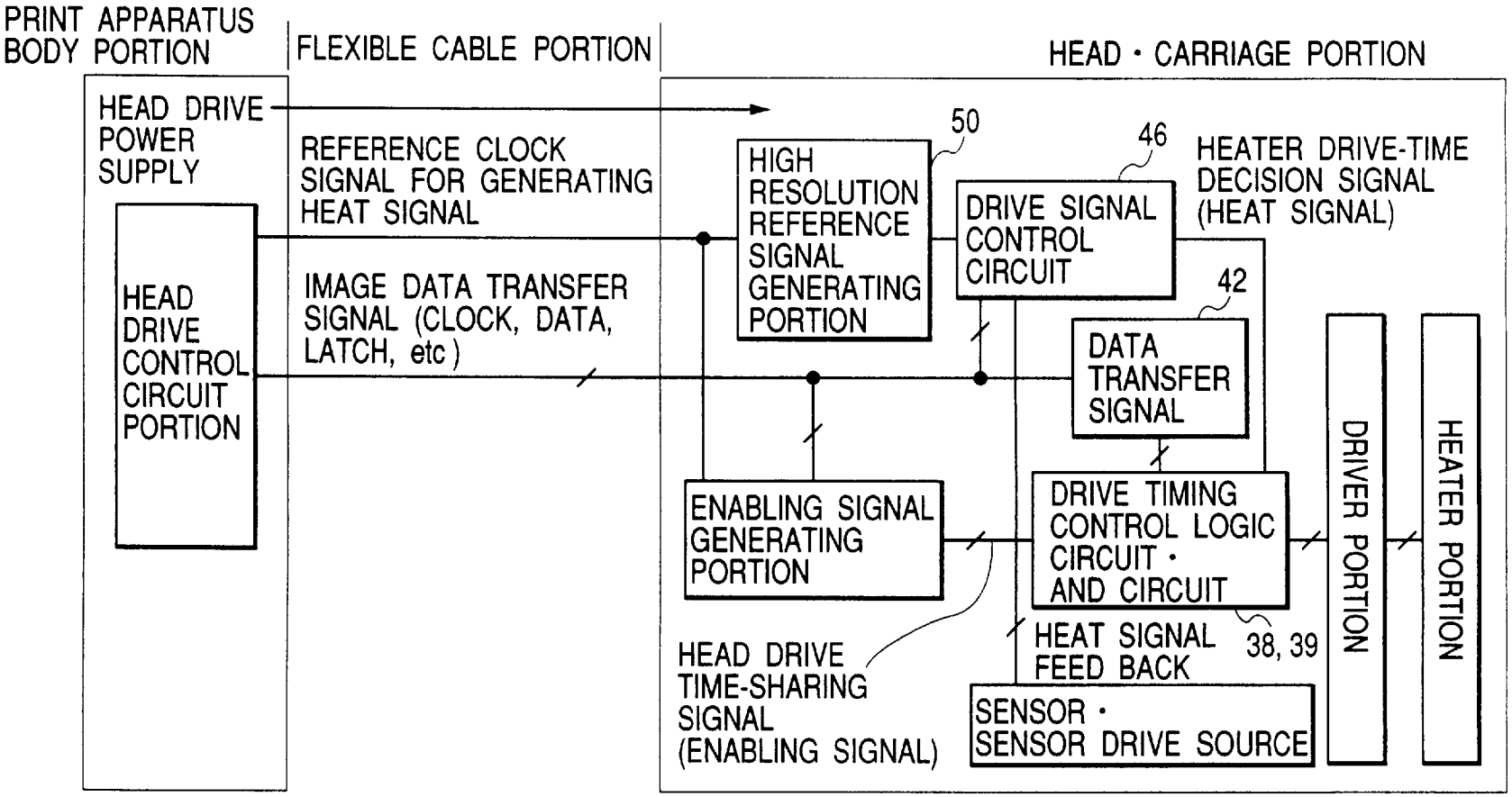
FIG. 9 is a block diagram showing the signal flow of a third embodiment.

FIG. 9 is a signal flow diagram showing a third embodiment of the present invention.

The description of the part common with that of FIG. 6 is omitted.

In the second embodiment, the enabling signal is generated from the high resolution reference signal and image data transfer signal, but in the present embodiment, the enabling signal is generated from the reference input signal before inputted to the high resolution reference signal generator and the image data transfer signal. Since the enabling signal may have a small resolution with respect to the heat signal, the original reference input signal may be utilized without being passed through the high resolution reference signal generator with respect to some of the heater drive control signals. Here, when the resolution is reduced further than necessary, the constitution of a part for counting the high resolution reference signals CLK is disadvantageously enlarged (because the circuit is also enlarged with a larger count value), and it is also effective to mix the signals which are passed and are not passed through the high resolution reference signal generator as occasion demands.

(Fourth Embodiment)

Figure 10:
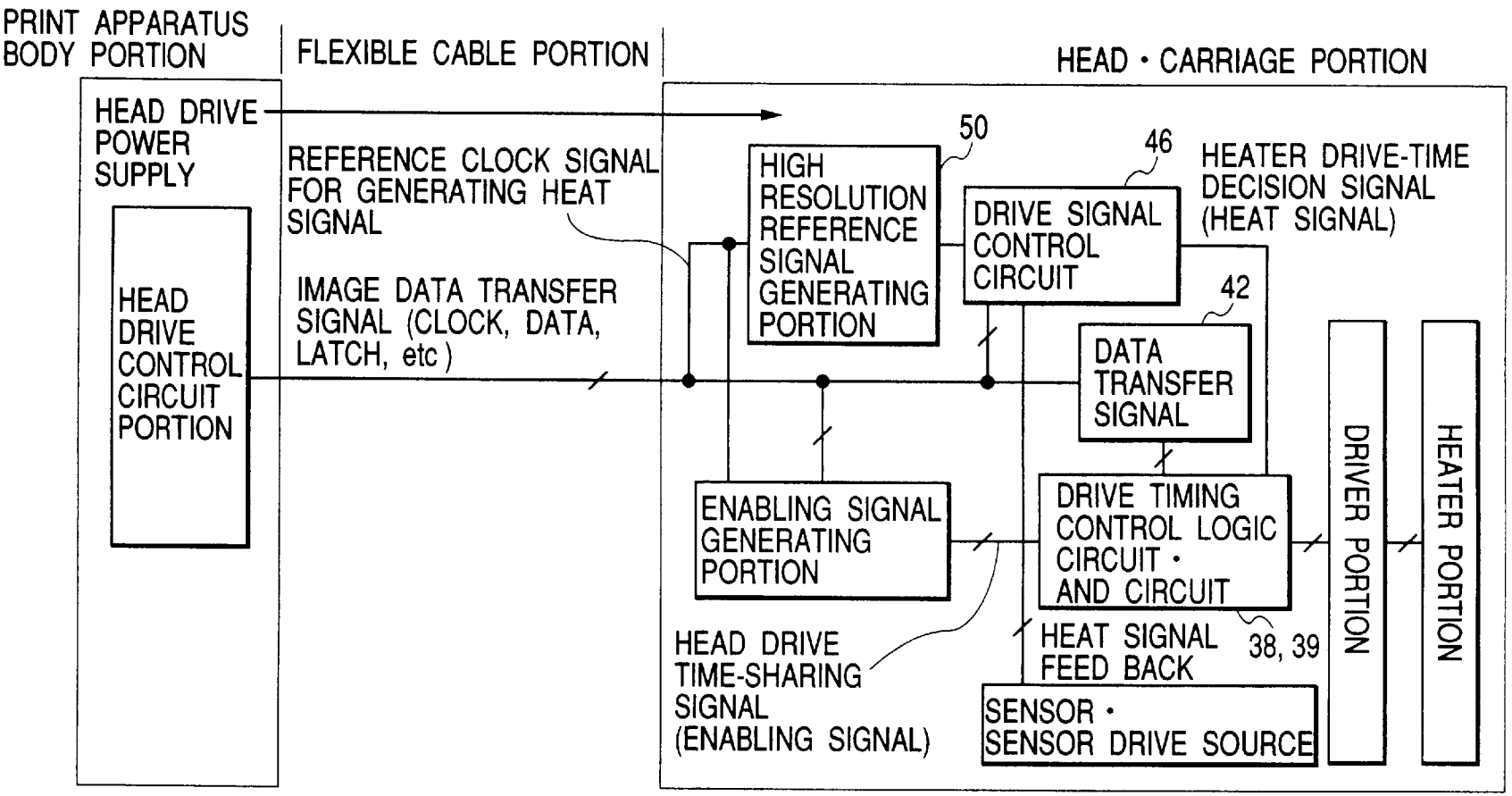
FIG. 10 is a block diagram showing the signal flow of a fourth embodiment.

FIG. 10 is a signal flow diagram showing a fourth embodiment of the present invention.

The description of the part common with that of FIG. 6 is omitted.

In the present embodiment, a data clock signal for use in data transfer is used generated as the reference input signal. According to this constitution, it is possible to reduce the number of signal lines further than in the second embodiment. In the present embodiment, since the number of clocks is limited by the number of data to be transferred, it is effective to mix the signals passed and not passed through the high resolution reference signal generator as in the third embodiment.

(Fifth Embodiment)

Figure 11:
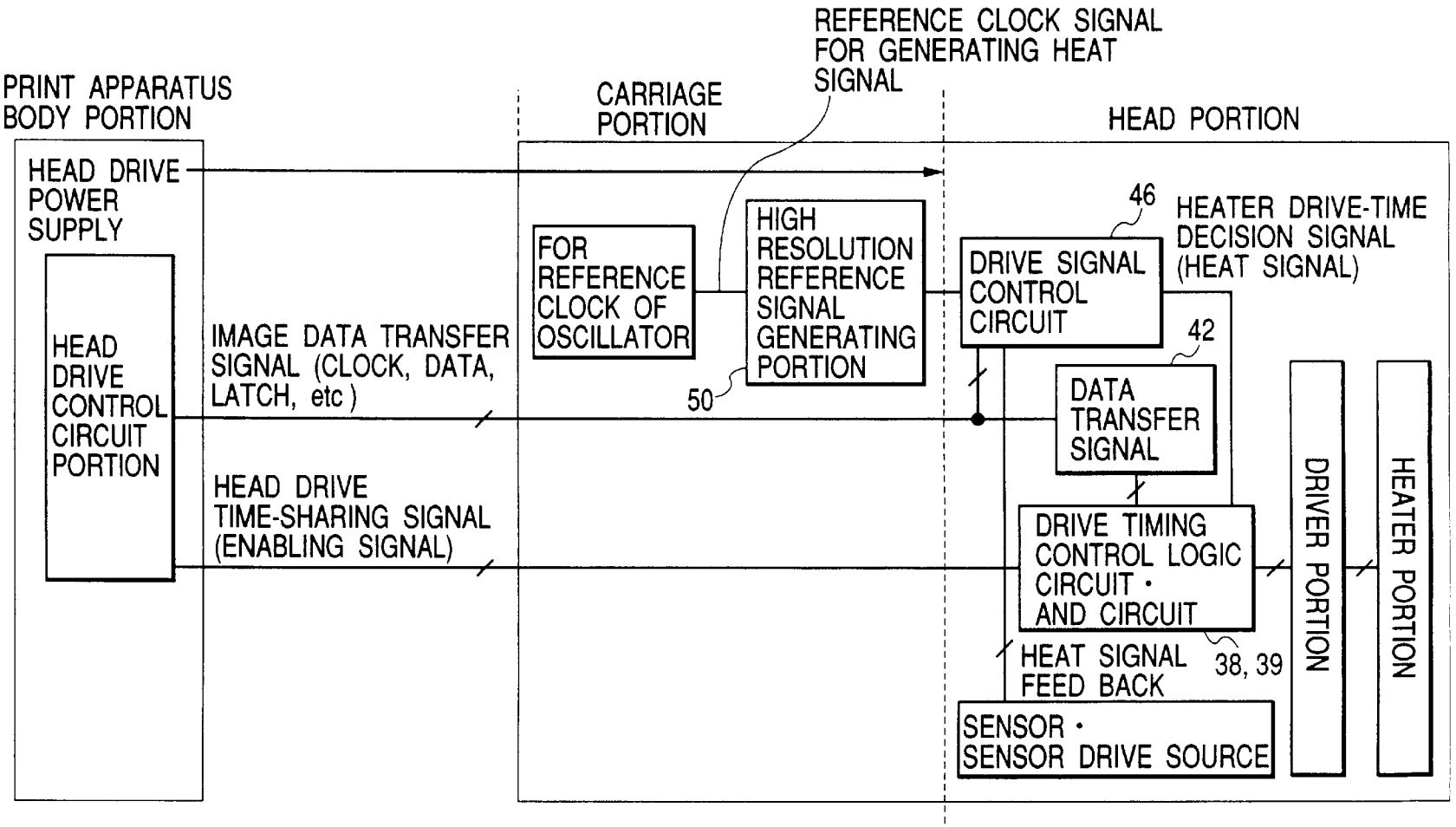
FIG. 11 is a block diagram showing the signal flow of a fifth embodiment.

FIG. 11 is a signal flow diagram showing a fifth embodiment of the present invention.

The description of the part common with that of FIG. 6 is omitted.

Figure 12:
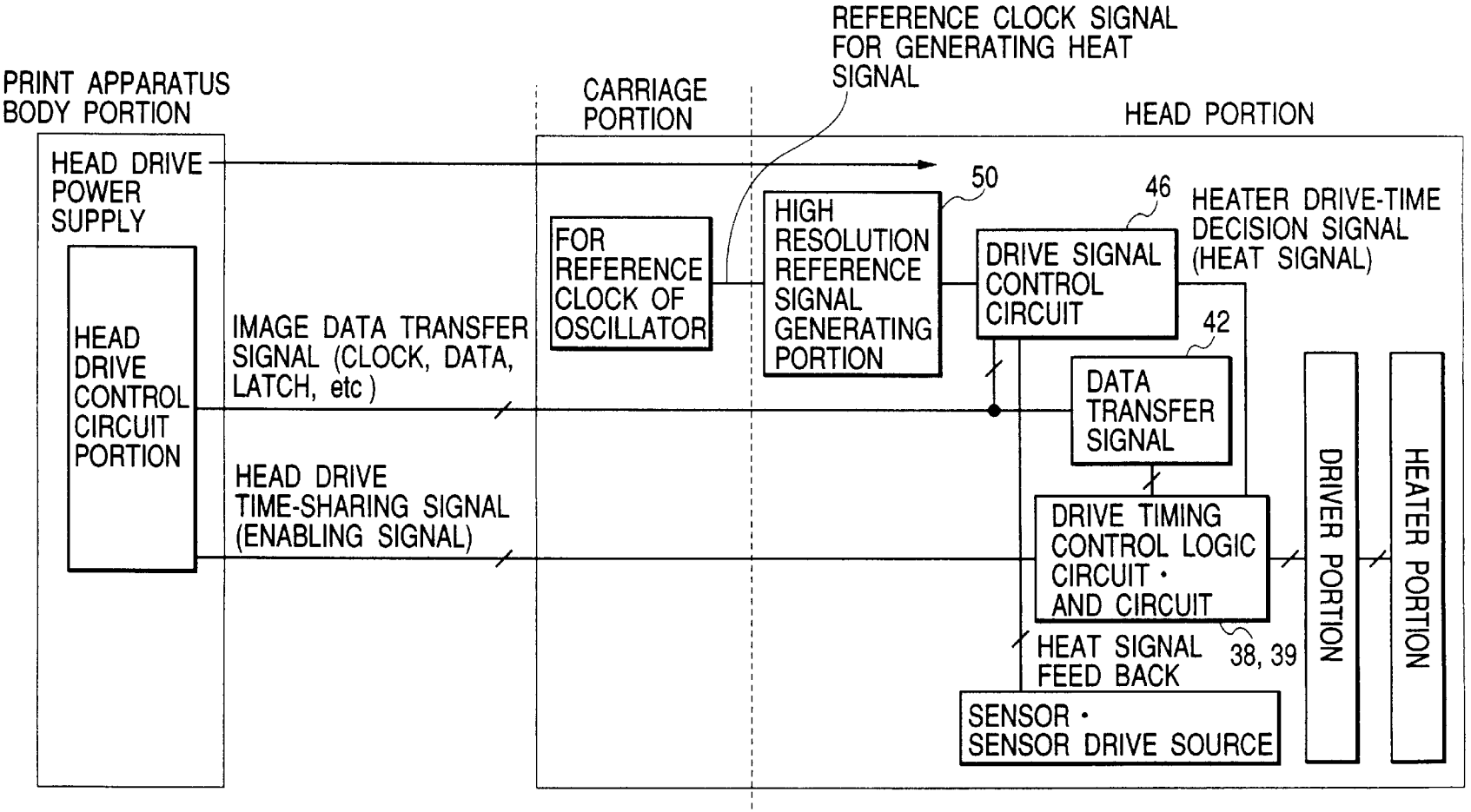
FIG. 12 is a block diagram showing a modification example of FIG. 11.
Figure 13:
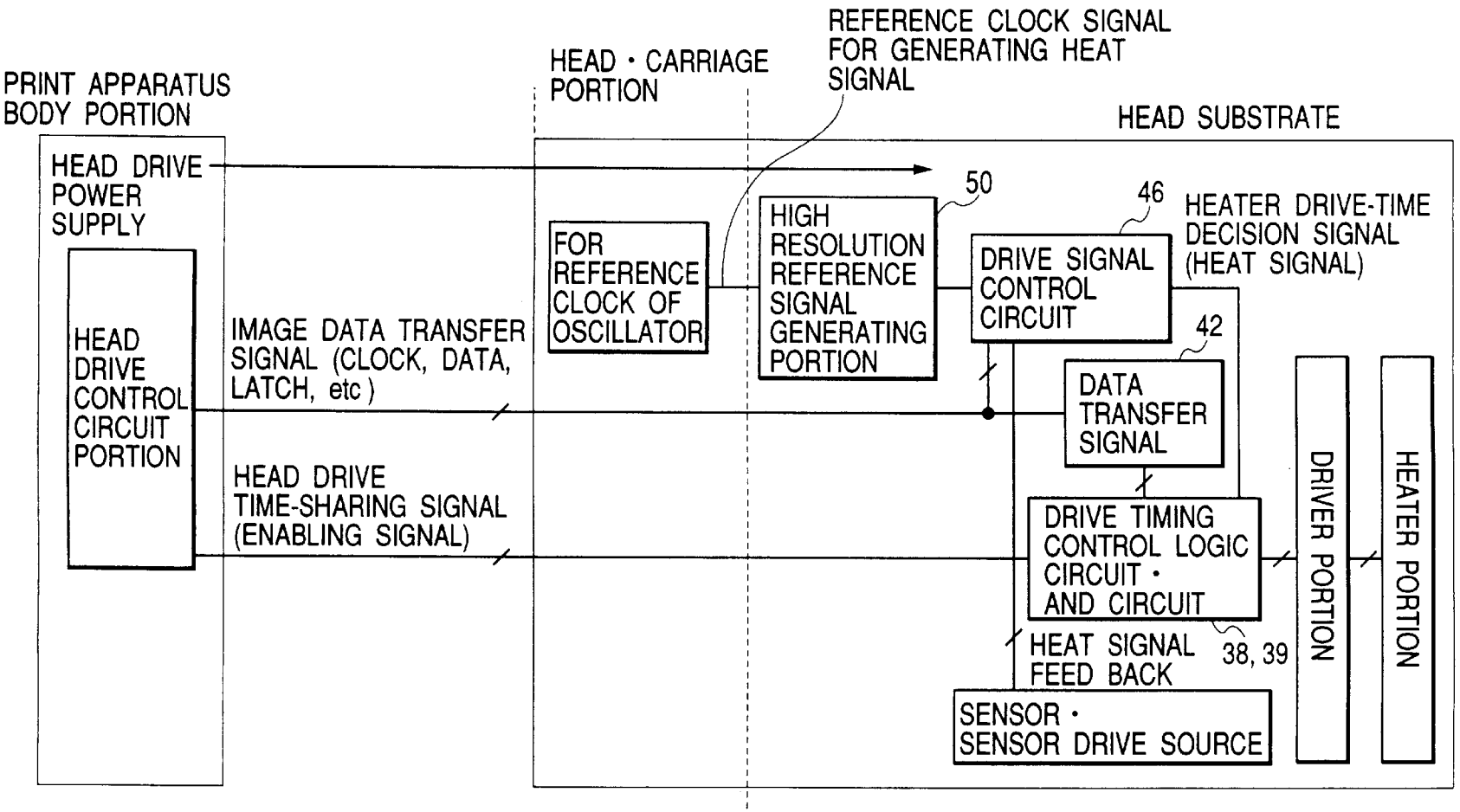
FIG. 13 is a block diagram showing further modification example of FIG. 11.

In the present embodiment, there is disposed an oscillator for generating the reference input signal in the head including the carriage. In this case, the signal line for the reference input signal can be eliminated. In the present embodiment, however, since a transmitter is easily influenced by the temperature, the transmitter is disposed in a carriage part to be positioned apart from the head heating part. Moreover, in the present embodiment, the high resolution reference signal generator is disposed on the carriage, but the reference signal waveform bluntness by the drawing of the wiring even on the carriage, and the radiation noise influence are found in some cases. Therefore, it is preferable to dispose the high resolution reference signal generator inside the head as shown in FIG. 12, or in the head substrate as shown in FIG. 13.

(Sixth Embodiment)

Figure 14:
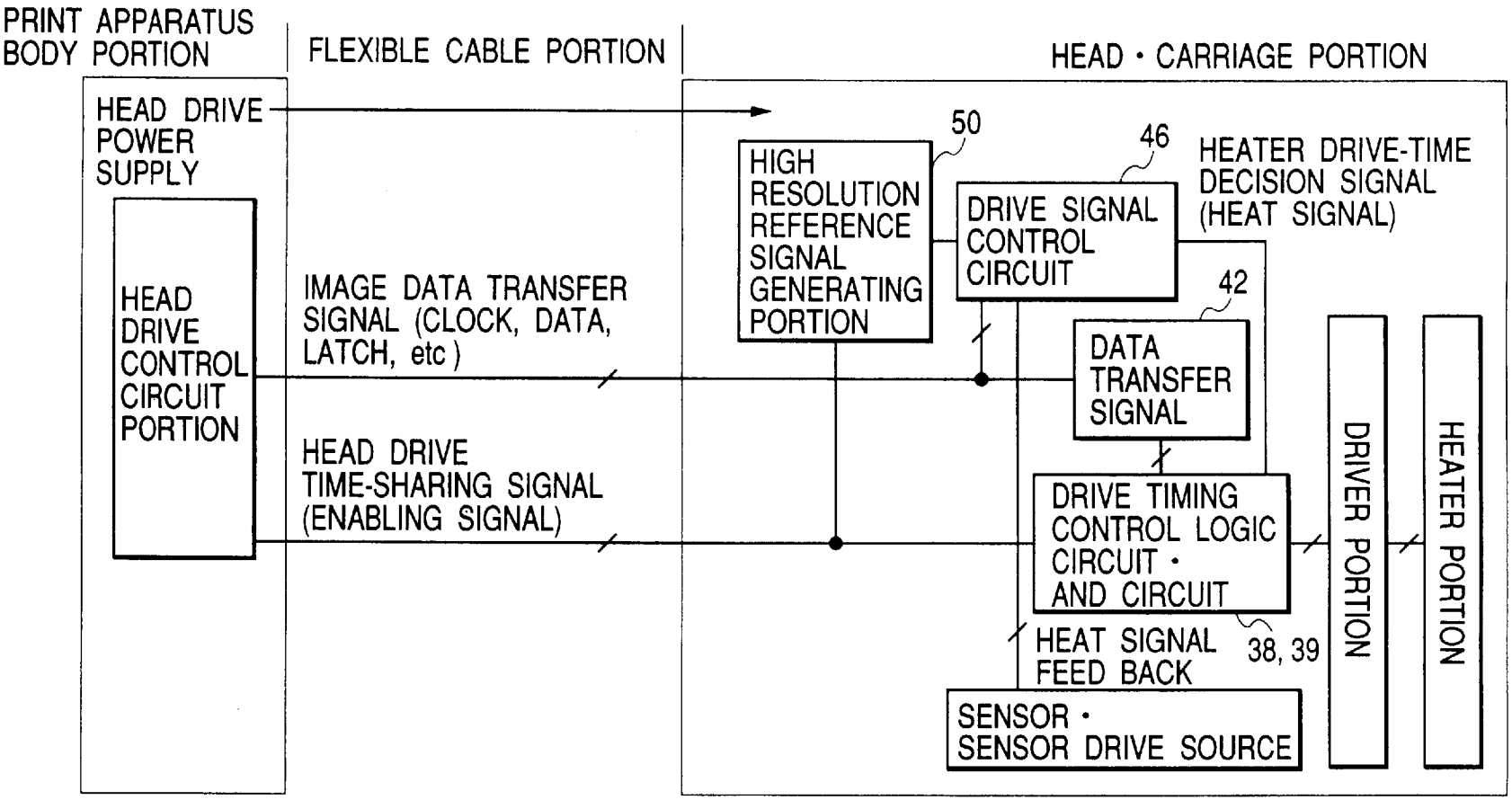
FIG. 14 is a block diagram showing the signal flow of a sixth embodiment.

FIG. 14 is a signal flow diagram showing a sixth embodiment of the present invention.

The description of the part common with that of FIG. 6 is omitted.

The present embodiment shows a constitution in which the high resolution reference signal is generated without using a single signal as the reference input signal and by using a plurality of other logic signals. Here, the high resolution reference signal is formed using a plurality of enabling signals. Specifically, the reference signals are formed by utilizing the timing deviations of a plurality of enabling signals, and the high resolution reference signal higher in frequency than any other enabling signal is generated. According to the present constitution, the reference input signal line can be eliminated.

The embodiments of the main part of the present invention have been described above, and other application examples which can preferably be applied to the present invention will be described hereinafter.

First, an ink jet recording head cartridge with the ink jet recording head of the present embodiment mounted thereon will schematically be described.

Figure 21:
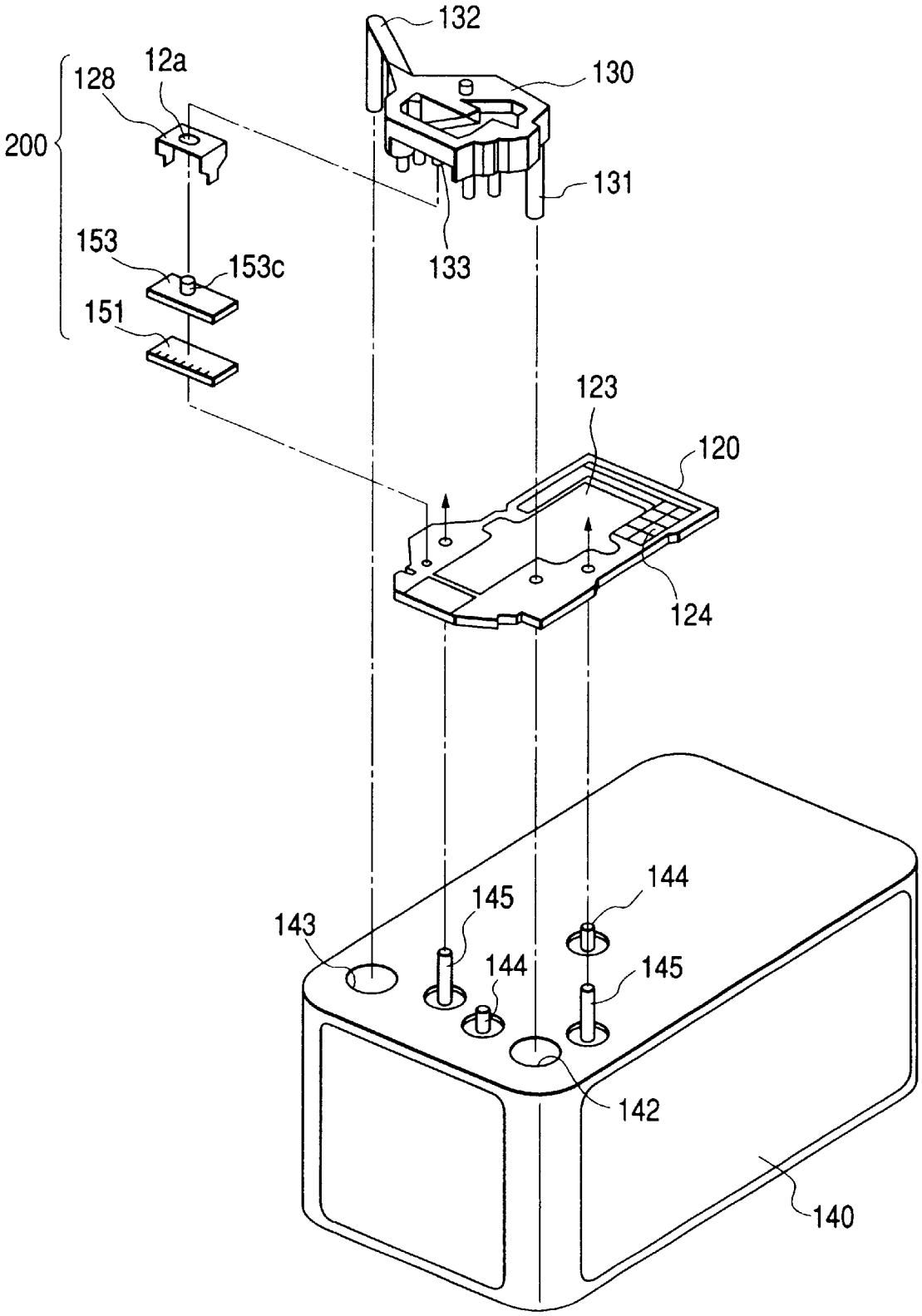
FIG. 21 is an exploded perspective view of an ink jet recording head cartridge to which the present invention can be applied.

FIG. 21 is a schematic exploded perspective view showing the ink jet recording head cartridge including the above-described ink jet recording head, and the ink jet recording head cartridge is mainly constituted of a liquid discharge head part 200 and a liquid container 140.

The liquid discharge head part 200 is constituted of an element substrate 151, a top plate 153 in which a discharge port is opened, a press spring 128, a liquid supply member 130, an aluminum base plate (support) 120, and the like. In the element substrate 151, a plurality of heating resistance bodies for applying heat to the liquid as described above are arranged in a row. By bonding the element substrate 151 to the top plate 153, the liquid channel in which the discharged liquid is circulated (not shown) is formed. The press spring 128 is a member for exerting an urging force onto the top plate 153 in the direction of the element substrate 151, and the element substrate 151 and top plate 153 are satisfactorily formed integrally with the support 120 described later by this urging force. When the top plate is bonded to the element substrate, for example, by an adhesive, and the like, no press spring may be disposed. The support 120 supports the element substrate 151, and the like, and is further provided thereon with a printed wiring board 123, connected to the element substrate 151, for supplying the electric signal, and a contact pad 124, connected to the device side, for exchanging the electric signal with the device side.

The liquid container 140 contains the liquid to be supplied to the liquid discharge head part 200. Disposed outside the liquid container 140 are a positioning part 144 for disposing a connection member to connect the liquid discharge head part 200 to the liquid container 140, and a fixing shaft 145 for fixing the connection member. The liquid is supplied to liquid supply paths 131, 132 of the liquid supply member 130 via the connection member from liquid supply paths 142, 143 of the liquid container 140, and supplied to the common liquid chamber via liquid supply paths 133, 129, 153*c* of the respective members. Here, the liquid is supplied to the liquid supply member 130 from the liquid container 140 via two divided paths, but the path does not have to be necessarily divided.

Additionally, after the liquid is consumed, the liquid container 140 may be refilled with the liquid and used. For this, the liquid container 140 may preferably be provided with a liquid introduction port. Moreover, the liquid discharge head 200 may be integral with or separate from the liquid container 140.

Figure 22:
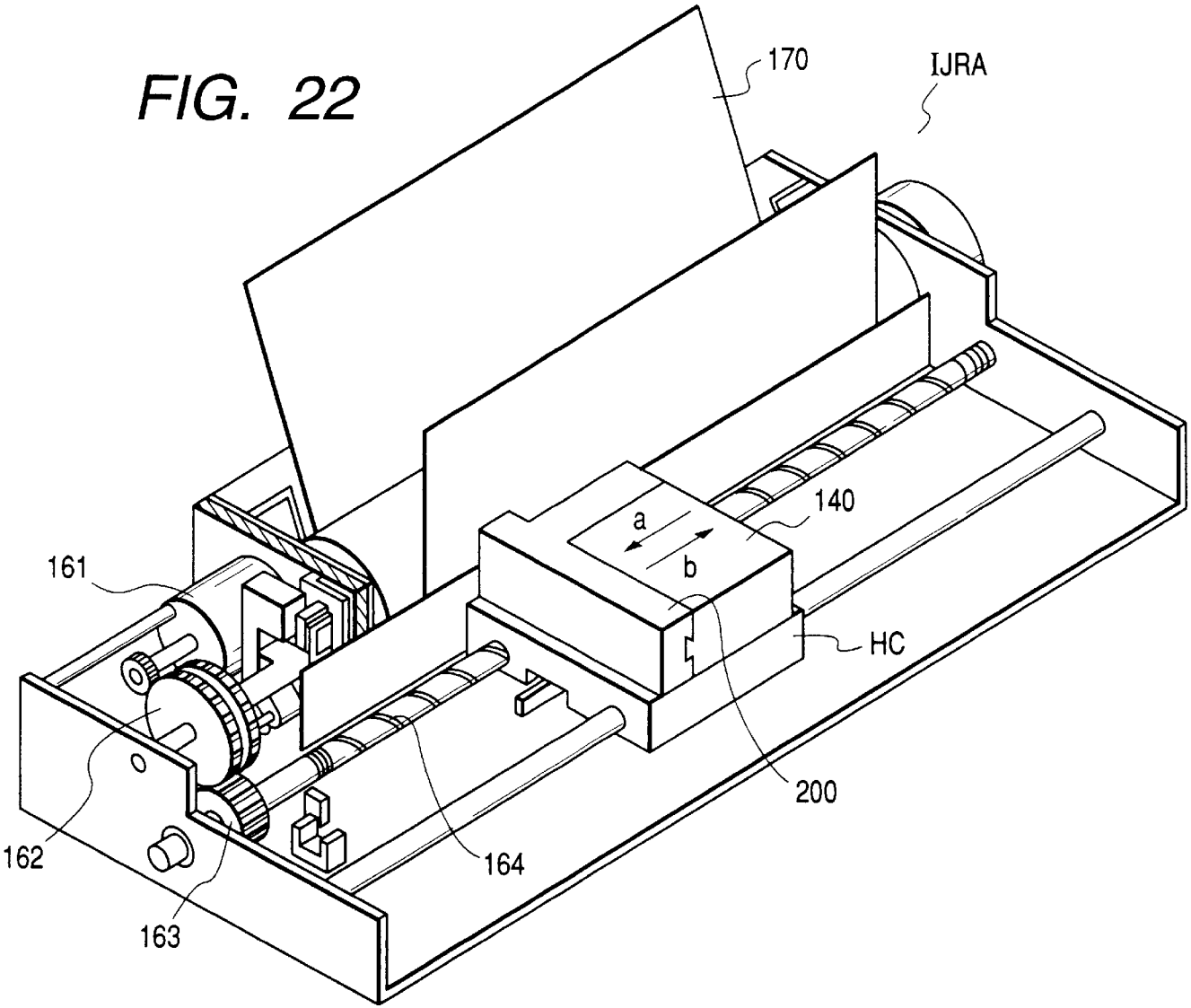
FIG. 22 is an schematic constitution diagram of an ink jet recording device to which the present invention can be applied.

FIG. 22 schematically shows the constitution of the ink jet recording device with the above-described ink jet recording head mounted thereon. In the present embodiment, particularly an ink jet recording device IJRA using the ink as the discharge liquid will be described. For the carriage (scanner) HC of the ink jet recording device, the head cartridge is mounted so that the liquid container 140 for containing the ink and liquid discharge head part 200 are detachable/attachable., and the carriage reciprocates/moves in the width direction (direction of arrows a, b) of a material to be recorded 170, such as a recording sheet, conveyed by record material conveying means. Additionally, the liquid container can be separated from the liquid discharge head part.

In FIG. 22, when the drive signal is supplied to the liquid discharge means on the carriage HC from drive signal supply means (not shown) via the flexible cable, a recording liquid is discharged to the material to be recorded 170 from the liquid discharge head part 200 in response to the signal.

Moreover, the ink jet recording device of this example is provided with a motor 161 as a drive source for driving the record material conveying means and carriage HC, gears 162, 163 for transmitting the power to the carriage HC from the drive source, a carriage shaft 164, and the like. By discharging the liquid to various materials to be recorded by the recording device, a satisfactory image recording can be obtained.

Figure 23:
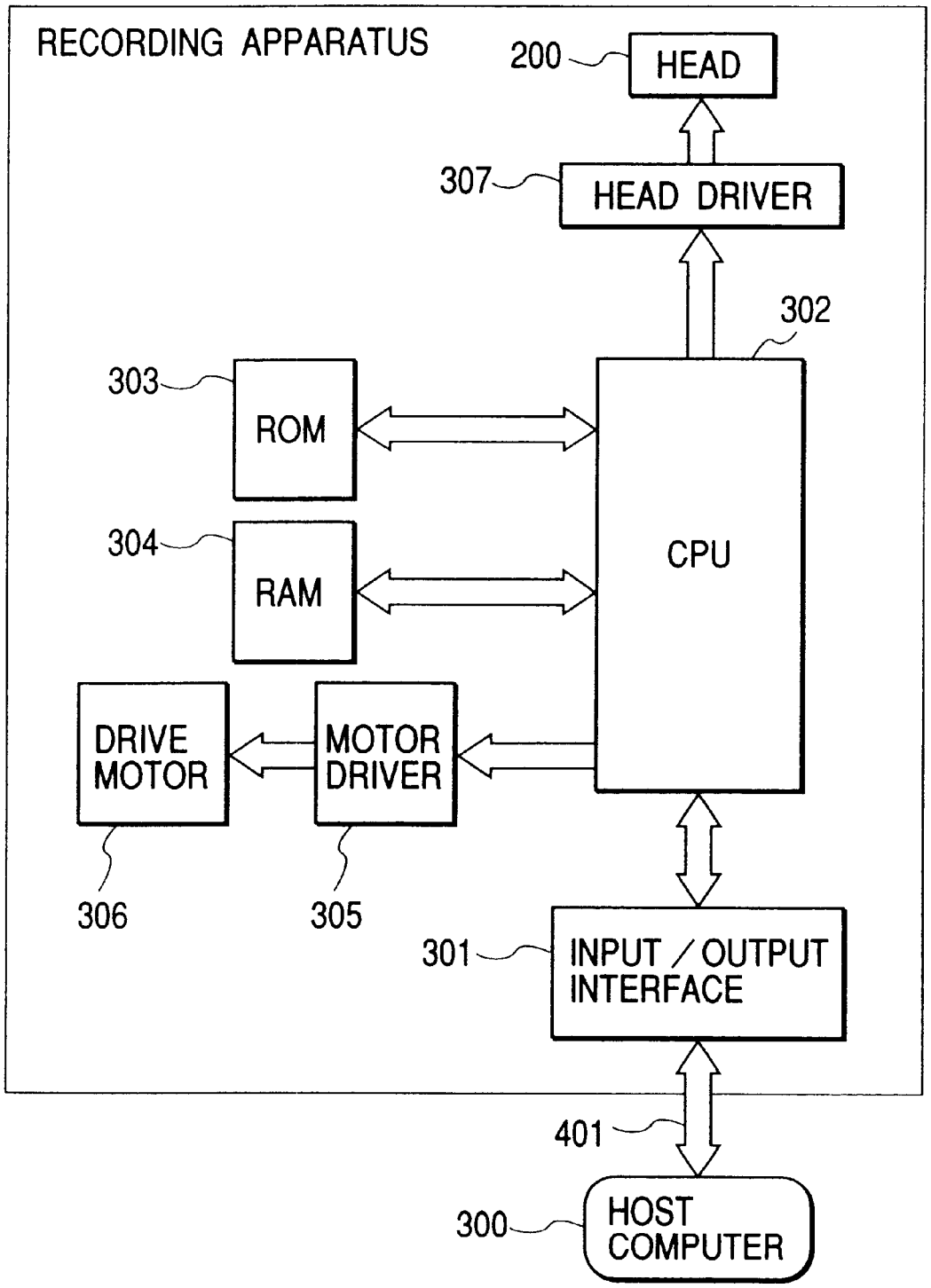
FIG. 23 is a device block diagram of the ink jet recording device to which the present invention can be applied.

FIG. 23 is an entire device block diagram for operating the ink jet recording device to which the ink jet recording head of the present invention is applied.

The recording device receives print information as the control signal from a host computer 300. The print information is temporarily saved in an input/output interface 301 inside the print apparatus, additionally converted to data which can be processed in the recording device, and inputted to CPU 302 which also serves as head drive signal supply means. The CPU 302 uses peripheral units such as RAM 304, processes the data inputted to the CPU 302 based on a control program stored in ROM 303, and converts the data to data to be printed (image data).

Moreover, the CPU 302 generates drive data for driving a drive motor 306 to move the recording sheet and head 200 in synchronization with the image data in order to record the image data in an appropriate position on the recording sheet. The image data and motor drive data are transmitted to the head 200 and drive motor 306 via a head driver 307 and motor driver 305, respectively, and the head and motor are driven at controlled timings to form the image.

As the material to be recorded which can be applied to the above-described recording device and to which the liquids such as the ink are applied, various types of paper or OHP sheets, plastic materials for use in compact disks, decorating plates, and the like, cloth, metal materials such as aluminum and copper, leather materials such as cowhide, pigskin and synthetic leather, wood materials such as wood and plywood, bamboo materials, ceramic materials such as tiles, three-dimensional structures such as sponge, and the like can be used.

Moreover, examples of the above-described recording device include a print apparatus for performing record on various types of paper and OHP sheets, a plastic recording device for performing record on the plastic materials such as the compact disk, a metal recording device for performing record on the metal plates, a leather recording device for performing record on the leather, a wood recording device for performing record on the wood materials, a ceramic recording device for performing record on the ceramic materials, a recording device for performing record on the three-dimensional net structures such as sponge, and a textile printing device for performing record on the cloth.

Moreover, as the discharge liquid for use in these ink jet recording devices, liquids suitable for the respective materials to be recorded and recording conditions may be used.

One example of an ink jet recording system will next be described in which the ink jet recording head of the present invention is used as a permanent type of recording head and the recording is performed on the material to be recorded.

Figure 24:
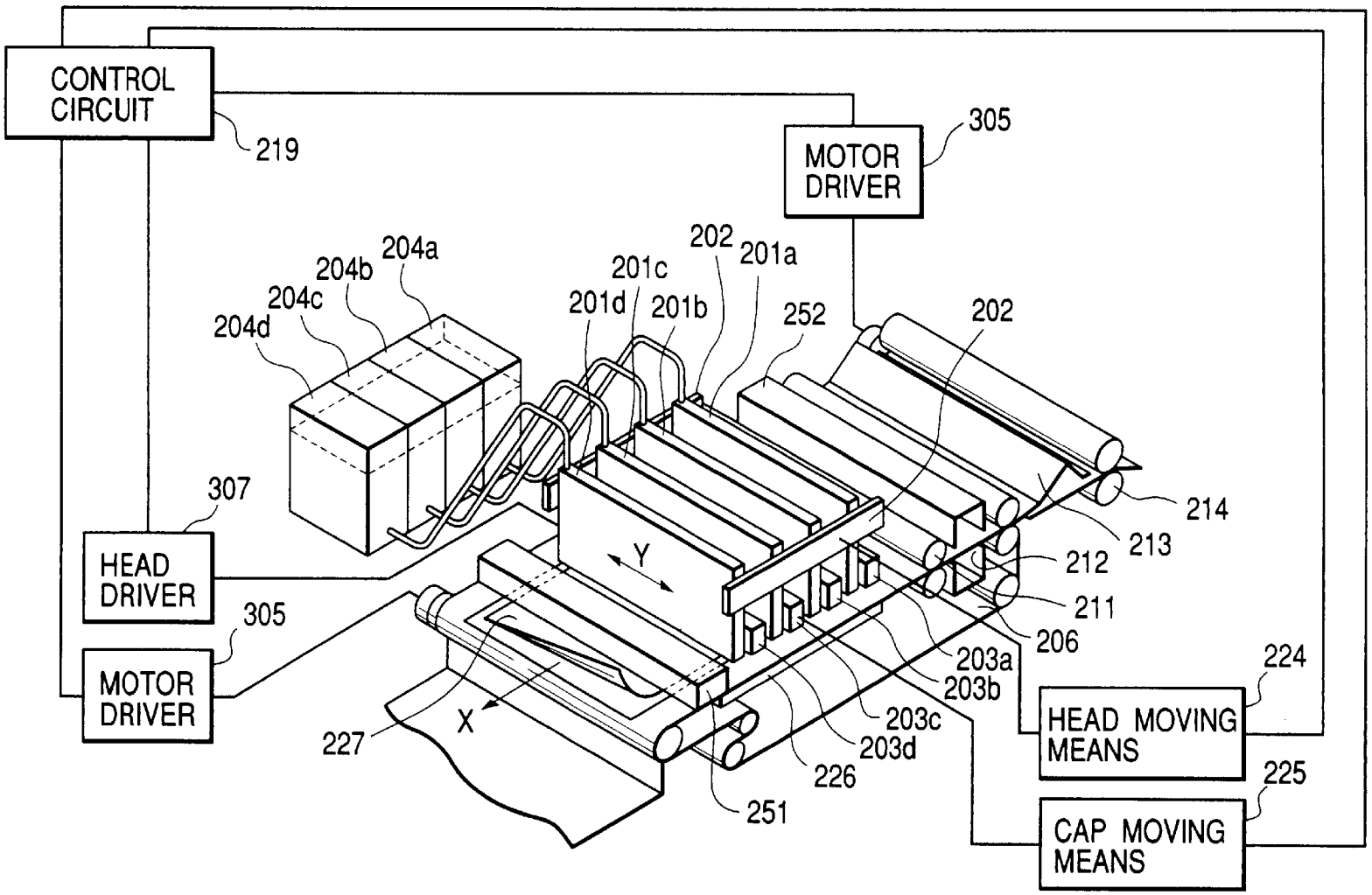
FIG. 24 is a diagram showing a liquid discharge system to which the present invention can be applied.
Figure 25:
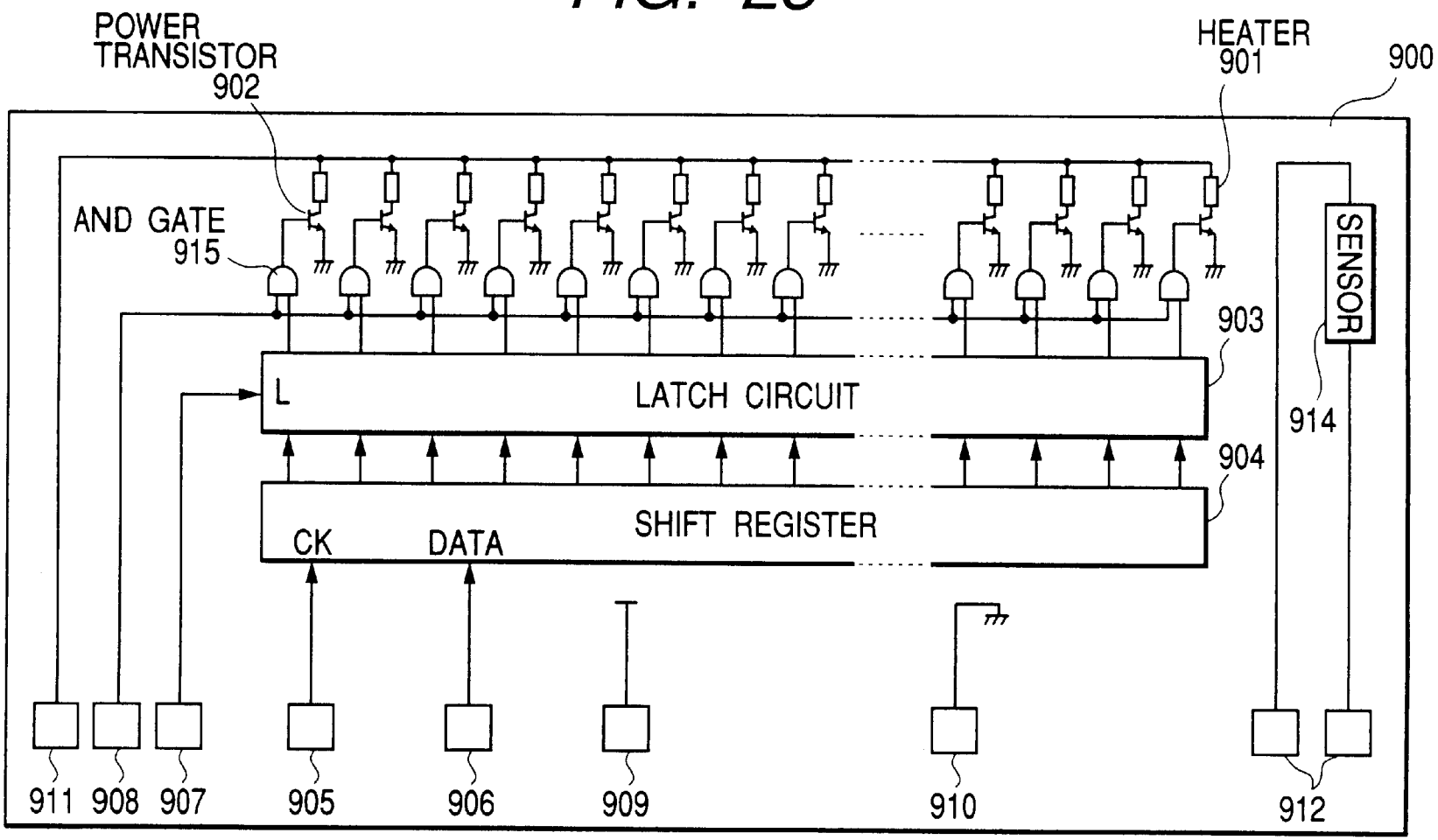
FIG. 25 is a circuit diagram of a conventional head element substrate.
Figure 26A:
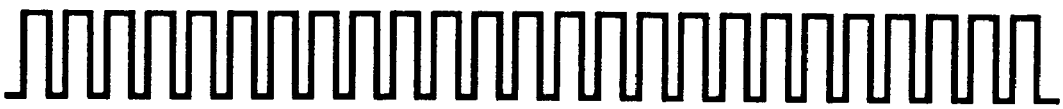
FIGS. 26A and 26B are explanatory views showing waveform bluntness.
Figure 26B:
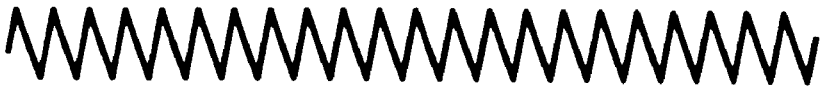

FIG. 24 is a schematic diagram showing the constitution of the ink jet recording device using the above-described ink jet recording head of the present invention. For the ink jet recording head of the present embodiment, a full line type head is provided with a plurality of discharge ports arranged at an interval of 360 dpi along a length corresponding to the recordable width of the material to be recorded, and four heads 201*a* to 201*d* for four colors of yellow (Y), magenta (M), cyan (C), and black (Bk) are fixed/supported by a holder 202 in parallel to one another with a predetermined interval in X direction.

A head driver 307 constituting drive signal supply means supplies signals to the respective heads 201*a* to 201*d*, and the respective heads 201*a* to 201*d* are driven based on the signals. Four color inks Y, M, C, Bk are supplied as discharge liquids to the respective heads 201*a* to 201*d* from ink containers 204*a* to 204*d*.

Moreover, head caps 203*a* to 203*d* provided therein with ink absorbing members such as sponge are disposed below the respective heads 201*a* to 201*d*, and maintenance can be performed on the heads 201*a* to 201*d* by covering the discharge ports of the respective heads 201*a* to 201*d* during non-recording.

Reference numeral 206 denotes a conveyance belt which constitutes conveying means for conveying various materials to be recorded as described in the above examples. The conveyance belt 206 is drawn along a predetermined passage, and driven by a driving roller connected to a motor driver 305.

In the present ink jet recording device, a pretreatment device 251 and a post-treatment device 252 for performing various treatments on the material to be recorded before and after performing record are disposed on the upstream and downstream of a material to be recorded conveying passage, respectively.

The pretreatment and post-treatment vary in treatment contents with the types of the materials to be recorded and inks. For example, the radiation of ultraviolet rays and ozone is performed as the pretreatment with respect to the metal, plastic, and ceramic materials to be recorded, so that the surfaces are activated to enhance the ink adherence. Moreover, in the plastic material to be recorded in which static electricity is easily generated, dust easily adheres to the surface by the static electricity, and the dust obstructs a satisfactory record in some cases. To solve the problem, as the pretreatment, the dust may be removed from the material to be recorded by using an ionizer to remove the static electricity from the material to be recorded. Moreover, when the cloth is used as the material to be recorded, as the pretreatment for preventing feathering and enhancing dyeing degree, the cloth may be provided with a substance selected from an alkaline substance, a water-soluble substance, a synthetic polymer, a water-soluble metal salt, urea and thiourea. The pretreatment is not limited, and a treatment of setting the temperature of the material to be recorded to a temperature appropriate for recording may be performed.

On the other hand, examples of the post-treatment include a thermal treatment of the material to be recorded with the ink attached thereto, a fixing treatment for promoting the fixing of the ink by ultraviolet radiation, and the like, a treatment for cleaning a non-reacted remaining pretreatment agent, and the like.

Additionally, in the present example, the heads 201*a* to 201*d* have been described using the full line heads, but they are not limited, and the above-described small head may be conveyed in the width direction of the material to be recorded to perform recording. Here, the head in this case also includes the above-described carriage part.

According to the present invention constituted as described above, the following effects are produced.

The period of some of a plurality of signals supplied from the outside is shortened by the period shortening circuit before the signals are supplied to the control circuit. Therefore, even when the period of the signal supplied from the outside is equal to the conventional period, a drive pulse signal for the ink jet recording head provided with the accelerated speed and increased nozzles can be generated with the high resolution and good precision.

Moreover, since the period of some of the signals for use in the recording control in the ink jet recording head is shortened, the period of the signal transmitted to the ink jet recording head provided with the accelerated speed and increased nozzles can be set to be the same degree as that of the conventional period. Therefore, the unnecessary radiation noise generated from the cable can be reduced, and the malfunction by the pulse waveform bluntness can be prevented.

What is claimed is:

1. An ink jet recording head comprising:

a plurality of recording elements for applying energy to discharge ink;

a recording element driver for driving said plurality of recording elements;

a control circuit for controlling said recording element driver; and a high resolution reference signal generator using a plurality of input signals continuously given from the outside in a predetermined period and generating a reference signal having a period shorter than the predetermined period, wherein recording control is performed by supplying the reference signal to said control circuit.

2. The ink jet recording head according to claim 1, wherein the reference signal is a recording control clock signal.

3. The ink jet recording head according to claim 1, wherein the plurality of input signals are data transfer clock signals.

4. The ink jet recording head according to claim 1, wherein the plurality of input signals are heat enabling signals.

5. The ink jet recording head according to claim 2, wherein a heater drive-time decision signal is generated by the reference signal and an image data transfer signal.

6. The ink jet recording head according to claim 1, wherein a head drive time-sharing signal is generated by the reference signal and an image data transfer signal.

7. The ink jet recording head according to claim 1, wherein a head drive time-sharing signal is generated by the plurality of input signals and an image data transfer signal.

8. The ink jet recording head according to claim 1, wherein said high resolution reference signal generator sets a signal period of at least some of the plurality of input signals given from the outside to be equal to 1/n times the signal period of the input signals, where n denotes a positive integer.

9. The ink jet recording head according to claim 5, wherein said high resolution reference signal generator is a PLL circuit.

10. The ink jet recording head according to claim 1, wherein said recording elements are heating elements.

11. The ink jet recording head according to claim 1, wherein said recording elements are piezoelectric elements.

12. The ink jet recording head according to claim 1, wherein said plurality of recording elements, said recording element driver, said control circuit, and said high resolution reference signal generator are formed on one semiconductor substrate.

13. The ink jet recording head according to claim 1, further comprising:

a first substrate and a second substrate, bonded to each other, for constituting a plurality of liquid channels to communicate with discharge ports for discharging the ink, wherein said plurality of recording elements, said recording element driver, said control circuit, and said high resolution reference signal generator are distributed to said first substrate and said second substrate in accordance with their functions.

14. The ink jet recording head according to claim 1, further comprising:

a discharge amount control element for controlling an amount of ink to be discharged; and a control element driver for driving said discharge amount control element, wherein said control circuit controls said control element driver.

15. The ink jet recording head according to claim 14, wherein said discharge amount control element is a heating element for warming the ink.

16. The ink jet recording head according to claim 14, wherein said discharge amount control element is an element for controlling a meniscus formed in a discharge port.

17. The ink jet recording head according to claim 14, wherein said discharge amount control element and said control element driver are formed on one semiconductor substrate.

18. The ink jet recording head according to claim 14, further comprising:

a first substrate and a second substrate, bonded to each other, for constituting a plurality of liquid channels to communicate with discharge ports for discharging the ink, wherein said discharge amount control element and said control element driver are distributed to said first substrate and said second substrate in accordance with their functions.

19. The ink jet recording head according to any one of claims 1 to 10, wherein said control circuit generates a drive pulse signal to be applied to said recording element driver from an output signal of said high resolution reference signal generator in accordance with a property and/or a state of a substrate on which said plurality of recording elements are formed.

20. The ink jet recording head according to any one of claims 14 to 16, wherein said control circuit generates a drive pulse signal to be applied to said control element driver from an output signal of said high resolution reference signal generator in accordance with a property and/or a state of a substrate on which said discharge amount control element is formed.

21. The ink jet recording head according to claim 20, wherein the property of said substrate is a resistivity of said recording element.

22. The ink jet recording head according to claim 20, wherein the state of said substrate is a temperature of said substrate.

23. An ink jet recording device comprising:

an ink jet recording head comprising a plurality of recording elements for applying energy to discharge ink, a recording element driver for driving said plurality of recording elements, and a control circuit for controlling said recording element driver;

a carriage on which said ink jet recording head is detachably mounted and which is scanned along a surface of a material to be recorded; and a main body device for transmitting a plurality of signals to be used for recording control to said ink jet recording head, wherein said ink jet recording head further comprises a high resolution reference signal generator for using an input signal continuously given from the outside in a predetermined period and generating a reference signal having a period shorter than the predetermined period, and the recording control is performed by supplying the reference signal to said control circuit.

24. The ink jet recording device according to claim 23, wherein said ink jet recording head is scanned along the surface of the material to be recorded and the plurality of signals from said main body device are inputted via a flexible cable.

25. The ink jet recording device according to claim 23, wherein at least some of the plurality of signals are transmitted to said ink jet recording head from said main body device via light.

26. An ink jet recording device comprising:

an ink jet recording head comprising a plurality of recording elements for applying energy to discharge ink, a recording element driver for driving said plurality of recording elements, and a control circuit for controlling said recording element driver;

a carriage on which said ink jet recording head is detachably mounted and which is scanned along a surface of a material to be recorded; and a main body device for transmitting a plurality of signals to be used for recording control to said ink jet recording head, wherein said ink jet recording device further comprises a high resolution reference signal generator for using an input signal continuously given from the outside in a predetermined period and generating a reference signal having a period shorter than the predetermined period, and the recording control is performed by supplying the reference signal to said control circuit.

* * * * *

UNITED STATES PATENT AND TRADEMARK OFFICE

CERTIFICATE OF CORRECTION

PATENT NO. : 6,467,863 B1
DATED : October 22, 2002
INVENTOR(S) : Yoshiyuki Imanaka et al.

It is certified that error appears in the above-identified patent and that said Letters Patent is hereby corrected as shown below:

Title page,
Item [56], References Cited, U.S. PATENT DOCUMENTS, "4,724,446 A 2/1988 Hirahar et al." should read -- 4,724,446 A 2/1988 Hirahara et al. --; and "4,973,184 A 11/1990 Sasaki" should read -- 4,973,984 A 11/1990 Sasaki --.
FOREIGN PATENT DOCUMENTS, "JP 256883 9/1995" should read -- JP 7-256883 9/1995 --.

Signed and Sealed this

Second Day of August, 2005

JON W. DUDAS
*Director of the United States Patent and Trademark Office*